US005142891A

United States Patent [19]

Kuwano

[11] Patent Number: 5,142,891

[45] Date of Patent: Sep. 1, 1992

[54] THICKNESS CONTROL SYSTEM FOR ROLLING MILL

[75] Inventor: Hiroaki Kuwano, Yokosuka, Japan

[73] Assignee: Ishikawajima-Harima Jukogyo Kabushiki Kaisha, Tokyo, Japan

[21] Appl. No.: 825,428

[22] Filed: Jan. 23, 1992

Related U.S. Application Data

[63] Continuation of Ser. No. 623,591, Dec. 7, 1990, abandoned.

[30] Foreign Application Priority Data

Dec. 25, 1989 [JP] Japan ..... 1-335314
Jul. 13, 1990 [JP] Japan ..... 2-185878

[51] Int. Cl.[5] ..... B21B 37/02; B21B 37/06

[52] U.S. Cl. ..... 72/11; 72/16; 72/17; 72/205

[58] Field of Search ..... 72/11, 16–21, 72/183, 205

[56] References Cited

U.S. PATENT DOCUMENTS

| | | | |
|---|---|---|---|
| 3,312,091 | 4/1967 | Kobayashi | 72/11 |
| 4,033,492 | 7/1977 | Imai | 72/17 |
| 4,187,707 | 2/1980 | Quehen | 72/205 |
| 4,548,063 | 10/1985 | Cox | 72/17 |
| 4,674,310 | 6/1987 | Ginzburg | 72/17 |
| 4,760,723 | 8/1988 | Nakagawa | 72/17 |
| 4,905,491 | 3/1990 | Starke et al. | 72/17 |
| 4,907,434 | 3/1990 | Hoshino et al. | 72/16 |
| 4,909,055 | 3/1990 | Blazevic | 72/16 |

FOREIGN PATENT DOCUMENTS 189811 8/1986 Japan .

*Primary Examiner*—Lowell A. Larson
*Assistant Examiner*—Thomas C. Schoeffler
*Attorney, Agent, or Firm*—Oblon, Spivak, McClelland, Maier & Neustadt

[57] ABSTRACT

A tension controller is disposed on an entry side or both on entry and exit sides of a rolling mill to quickly suppress tension fluctuation due to change of roll gap.

9 Claims, 22 Drawing Sheets

THICKNESS CONTROL SYSTEM FOR ROLLING MILL

This application is a continuation of application Ser. No. 07/623,591, filed on Dec. 7, 1990, now abandoned.

BACKGROUND OF THE INVENTION

The present invention relates to a thickness control system for a hydraulically loaded rolling mill to ensure highly responsive thickness control for a workpiece.

FIG. 1 shows, as an example of coventional hydraulically loaded rolling mills, a single stand reverisble cold rolling mill 32 having coiling and uncoiling reels 20 and 27 on entry and exit sides. More specifically, a workpiece 30 to be rolled is fed from the reel 20 driven by a motor 19 and passes through a deflector roll 21 and is rolled between upper and lower work rolls 3 and 4. The workpiece 30 rolled passes through a further deflector roll 26 and is coiled by the reel 27 driven by a motor 28. The reel driving motors 19 and 28 are respectively associated with reel-motor tension controllers 18 and 29 so as to keep constant tensions of the workpiece on the entry and exit sides, respectively. Generally, the tension controllers 18 and 29 serve to control the tensions in proportion to motor currents. Rolling velocity or speed in a rolling line is controlled to a predetermined value by controlling work-roll driving motor 23 by a speed controller 24.

In FIG. 1, reference numeral 1 denotes a load cell for detecting a rolling pressure; 2 and 5, upper and lower back-up rolls; 6, a hydraulic cylinder for setting a roll gap between the work rolls 3 and 4; 8, a servo valve connected through a piping 7 to the cylinder 6; 9, a displacement gage for sensing displacement of a draft ram 6' in the cylinder 6; 10, a servo amplifier for transmitting a command in the form of a current signal to the servo valve 8; and 11, a coefficient multiplier for providing a control gain $K_G$ to amplify an output signal from a comparator 12 to control a draft position S' of the ram 6'.

In a basic position control loop, an instruction signal R is compared with an output signal S from the displacement gage 9 and a signal e representative of any deviation derived is multiplied by the gain $K_G$ in the coefficient multiplier 11. With the multiplied signal, the opening of the servo valve 8 is controlled through the servo amplifier 10 to quantitatively adjust a pressure oil supplied through the piping 7 to the cylinder 6, thereby controlling the position S' of the ram 6'. As a result, the lower back-up and work rolls 5 and 4 are displaced to adjust the roll gap between the work rolls 3 and 4 to a predetermined value. Thus, a hydraulic roll-gap control system 66 is provided.

Control of only the position S' of the ram 6' would cause error in the roll gap between the work rolls 3 and 4 due to elongation of the mill which have received the rolling pressure. To overcome this problem, compensation is made usually as follows. Reference rolling pressure $P_{ref}$ is stored at a proper timing after starting of the rolling. Difference $\Delta P$ between the reference rolling pressure $P_{ref}$ and an actual rolling pressure during the rolling which is detected by the load cell 1 and is in the form of a signal P is calculated by a comparator or adder-subtractor 17 and then is divided by a mill modulus $K_m$, which is specific in a mill just like a spring constant and has been detected in advance, in a coefficient multiplier 16 of a mill modulus control unit 54 to calculate an elongation of the mill. The calculated elongation is multiplied with a correcting gain c which will set a percentage of correction, thereby obtaining a modifying signal $C_p$ is given to modify the position S' of the ram 6'. The signal $C_p$ is given to the adder 13 as the instruction for the above basic position control loop to correct the position S' of the ram 6'. This procedure is generally called mill modulus control.

Further, in order to make absolute thickness of the workpiece 30 on the exit side of the mill into a desired or reference value $h_{ref}$, a signal h representative of an actual thickness of the workpiece sensed by thickness gage 25 (or a thickness gage 22 in the case of a rolling in the reverse direction) on the exit side of the rolling mill 32 is compared with the reference value $h_{ref}$ by a comparator or adder-subtractor 31 to obtain a thickness deviation $\Delta h$. This deviation is passed through an integral controller 15 and is multiplied with a correction gain $1+(M/K_e)$ for correction into an actual draft position in a coefficient multiplier 14 to obtain a modifying signal $C_h$ for correction of the position S' of the ram 6'. The modifying signal $C_h$ is also given to the adder 13 as an instruction of the above basic position control loop to correct the position S' of the ram 6'. This procedure is called monitor AGC. Here, M is a constant representative of hardness of the workpiece 30 and has been detected in advance. $K_e$ is a controlled mill modulus and will satisfy the equation: $K_e=K_m/(1-c)$.

When the position S' of the draft ram 6' is changed to control the thickness of the workpiece 30 in the rolling mill in FIG. 1, the tensions applied to the workpiece 30 on the entry and exit sides fluctuate. For example, when the roll gap between the work roll 3 and 4 is narrowed down so as to decrease the thickness of the workpiece 30, the workpiece 30 will elongate and the tensions on the entry on the exit sides will decrease. Such fluctuation of the tensions may be absorbed by change of peripheral velocities of the reels 20 and 27 having much inertia; but, such absorptive response is generally slower by one or more digits than hydraulic roll-gap control. This means that, once the roll gap is changed and the tensions of the workpiece 30 on the entry and exit sides fluctuate, the tensions cannot be returned to preset values as quickly as the hydraulic roll-gap control. As a result, the decrease of the tensions on the entry and exit sides will cause deformation resitance on the workpiece 30 to apparently increase to nullify the narrowing of the roll gap, with a disadvantageous result that the workpiece thickness is not decreased. Namely, when attempt is made to decrease the workpiece thickness under the high-response hydraulic roll-gap control, the workpiece thickness cannot be thinned down at a rate higher than rate of responsive change of peripheral velocities of the reels 20 and 27. Therefore, disturbance of thickness on the entry side of, say, 2–3 Hz or more cannot be eliminated by hardening the mill by the above-mentioned mill modulus control since the thickness control is not responsive for the above reason mentioned.

It is often heard at rolling factories that thickness control accuracy cannot be improved as expected when the position S' of the ram 6' is controlled quickly by the hydraulic roll-gap control system 66. This will be attributed to the above reason.

FIG. 2 shows a computer simulation example done by the inventor, which will support the above-mentioned fact. An object simulated is the single stand reversible cold rolling mill shown in FIG. 1 where a workpiece with width of 1800 mm, entry side thickness of 0.52 mm, entry side setting tension of 1.36 tons and exit side setting tension of 2.35 tons is rolled at rolling speed of 1800 m/min. into thickness of 0.3 mm, roll gap being decreased midway and stepwise by 10 μm. Assumption is such that response of hydraulic roll-gap control is 20 Hz with 90 degrees phase lag in frequency response and a desired value is reached with 0.04 second or less in step response. According to simulated results, thickness change Δh on the exit side reaches a steady value within about 1 second when roll gap is changed by 10 μm. In the actual hydraulic roll-gap control system, a desired value in the system is reached with 0.04 second while the thickness is changed by 25 times as slow as this, which is attributed to the fact that the response in terms of change of peripheral velocities of the reels 20 and 27 on the entry and exit sides is slow as described above. That is, the reels 20 and 27, tensions of which are controlled by making the motor currents constant, have considerably great inertia including the motors 19 and 28 so that change of the peripheral velocities of the reels to some steady values for suppression of tension fluctuations is reached within about 1 second.

The present invention was made to overcome the above and other problems encountered in the prior art and provides a thickness control system for a rolling mill which can enhance the response of thickness control to attain product thickness at high accuracy.

SUMMARY OF THE INVENTION

The present invention provides, in a thickness control system for a rolling mill having a hydraulic roll-gap control system for setting a roll gap between upper and lower work rolls and a mill modulus control unit for outputting an instruction signal to said hydraulic roll-gap control system on the basis of any difference between a reference rolling pressure and an actual rolling pressure during rolling detected by a load cell, an improvement comprising a tension controller on an entry side or both entry and exit sides of the mill for adjusting a tension or tensions applied on the workpiece. The improvement may further comprises a thickness gage on the entry side for detecting a thickness of the workpiece to be rolled, a speed detector on the entry side for detecting a feed speed of the workpiece, a further thickness gage on the exit side for detecting a thickness of the workpiece rolled, a roll gap change computing element on the exit side for obtaining a roll gap change by a signal from the thickness gage, for calculating a timing of roll gap change by a signal from the speed detector and for outputting a roll gap change quantity signal to said hydraulic roll-gap control system, a mill modulus computing element for obtaining an optimal mill modulus by a signal or signals from said load cell and/or from the thickness gage on the exit side and a correction gain setter for obtaining a correction gain based on a mill modulus signal from the mill modulus computing element to output a correction gain signal to said mill modulus control unit.

Provision of the tension controllers on the entry side or on both the entry and exit sides of the rolling mill will contribute to quick suppression of any tension fluctuations due to the change of roll gap.

Thickness fluctuation on the entry side is measured by the thickness gage on the entry side and feed speed of the workpiece is measured by the speed detector. Based on signals from the thickness gage and speed detector, the roll gap change computing element calculates the roll gap change quantity and the timing of the entry side thickness fluctuation passing between the upper and lower work rolls. The roll gap change signal $C_F$ is outputted to the hydraulic roll-gap control system to adjust the roll gap between the work rolls to thereby eliminate the thickness fluctuation on the entry side. Based on the signal or signals from the load cell and/or the thickness gage on the exit side, optimal mill modulus for eliminating influence or disturbance component caused by the rolling mill itself such as roll eccentricity to the exit side thickness is obtained by the mill modulus computing element. The correction gain is obtained by the correction gain setter based on the mill modulus signal from said mill modulus computing element and a correction gain in the mill modulus control unit is changed by the correction gain signal from said correction gain setter. As a result, high-response controlling property of the hydraulic roll-gap control is maximumly utilized to enhance the response in thickness control, thereby obtaining product thickness with higher accuracy.

BRIEF DESCRIPTION OF THE DRAWINGS

FIGS. 5–7 show results of computer simulation representing the response when the response of reel-motor tension controllers 18 and 29 is assumed to be higher by third times in the conventional system of FIG. 1 wherein FIG. 5 shows a case where the response is assumed to be higher in the tension controllers 18 and 29 on the entry and exit sides, FIG. 6 represents a case where the response is assumed to be higher only in the tension controller 29 on the exit side, and FIG. 7 shows a case where the response is assumed to be higher only in the tension controller 18 on the entry side;

DETAILED DESCRIPTION OF THE PREFERRED EMBODIMENTS

First Embodiment

Figure 1:
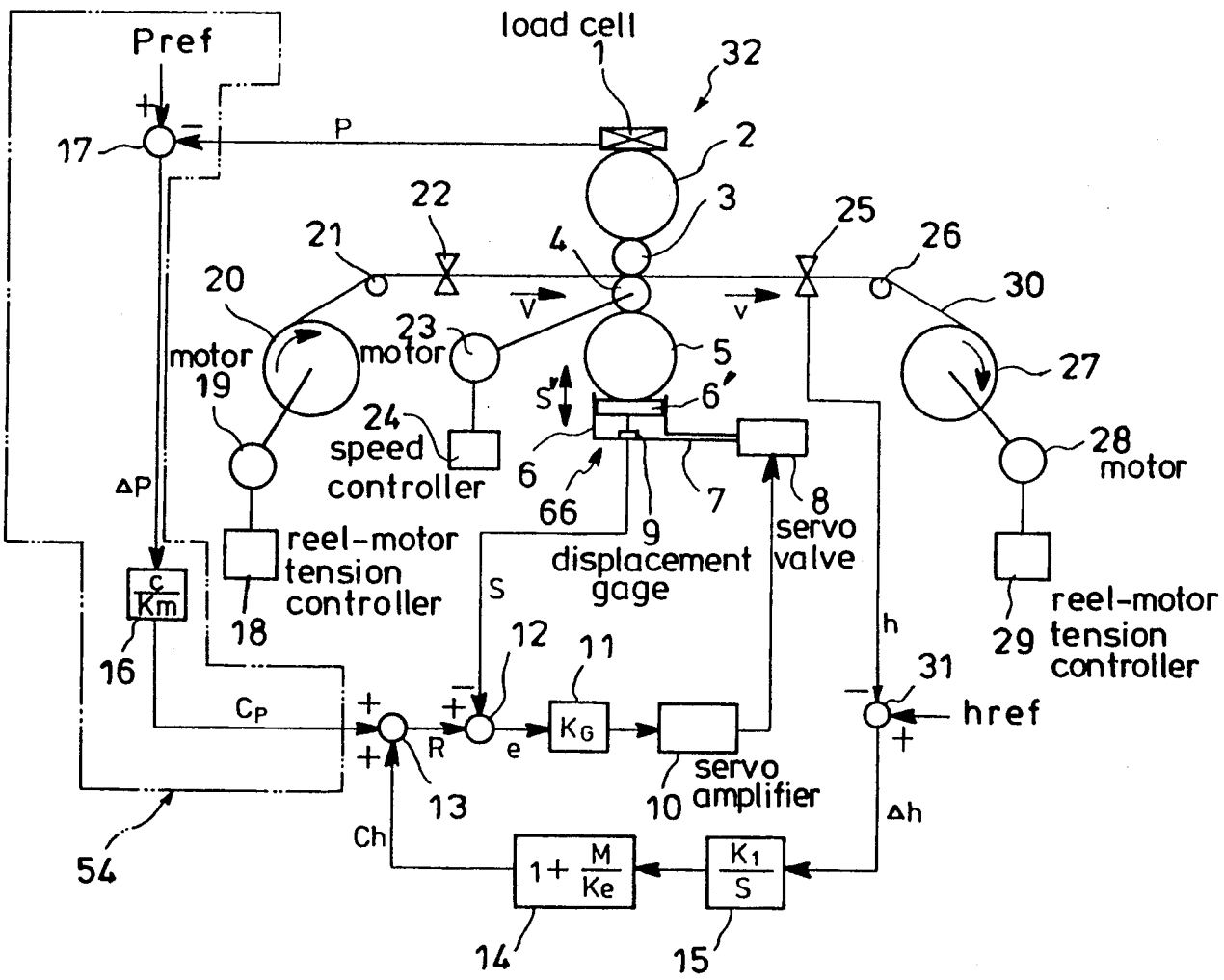
Fig.1 PRIOR ART
FIG. 1 is a general block diagram showing a conventional system.
Figure 3:
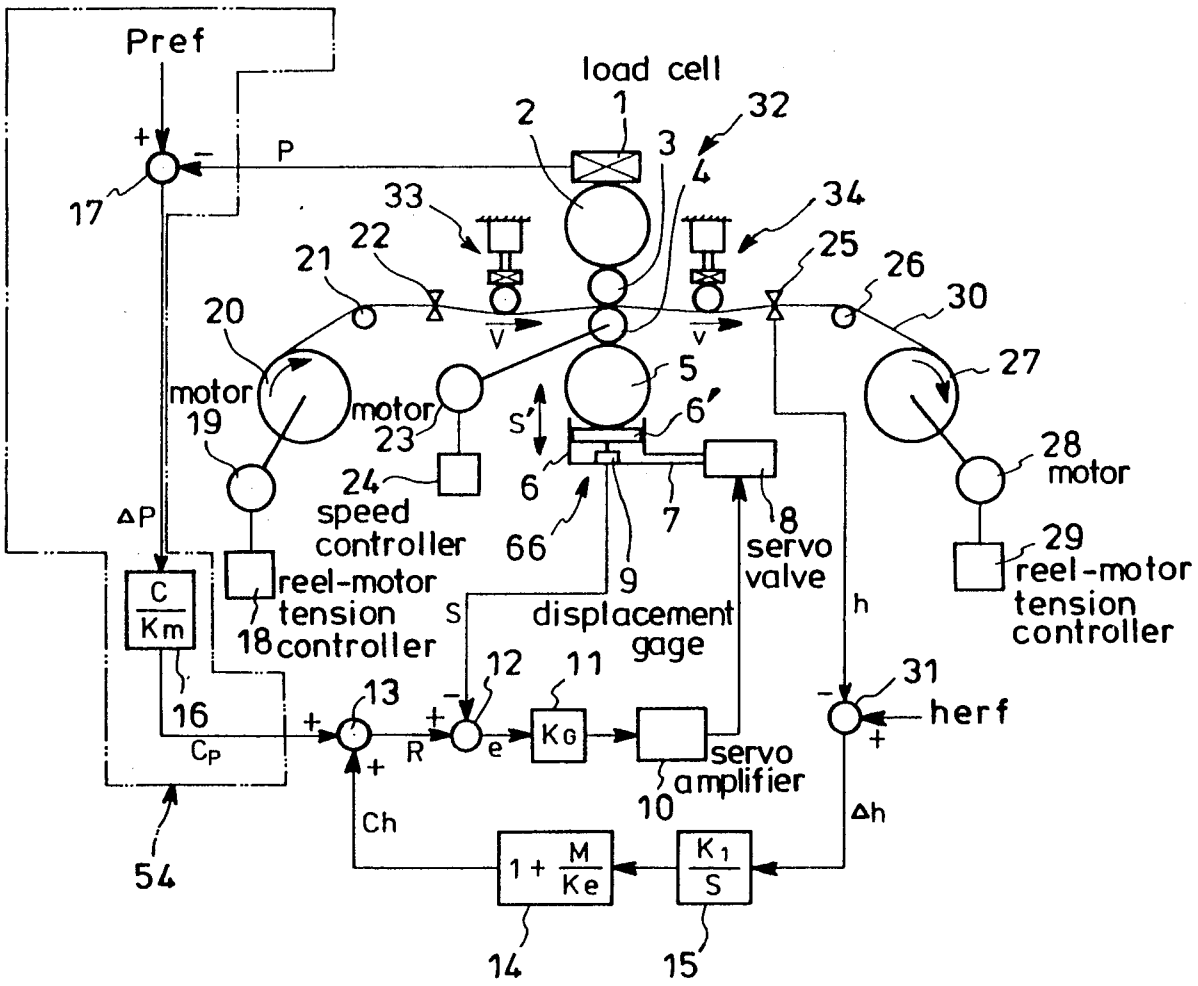
FIG. 3 is a general block diagram showing a system of a first embodiment of the present invention.

FIG. 3 shows a first embodiment of the present invention applied to a single stand reversible cold rolling mill in which a tension controllers 33 and 34 are disposed on both the entry and exit sides of the conventional rolling mill 32 in FIG. 1. The component parts shown in FIG. 1 are referred by the like numerals with the description therefor being omitted here.

Figure 4:
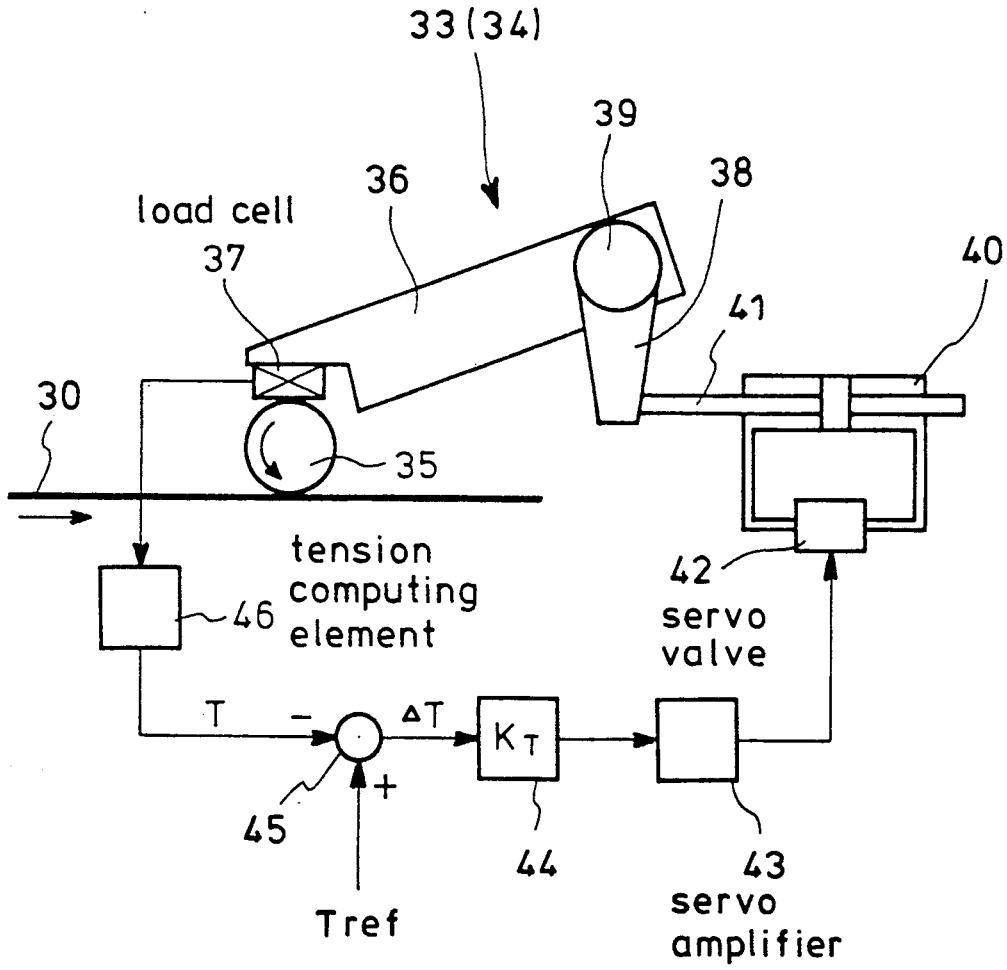
FIG. 4 represents a specific example of the tension controller 33 and 34 in FIG. 3.

FIG. 4 represents an example of the tension controllers 33 and 34 in which a pressure roll 35 is rotatably supported on an arm 36 and holds the workpiece 30. A load detector or load cell 37 is mounted on a bearing for the pressure roll 35 to detect a reaction force from the workpiece 30. The arm 36 is connected with a lever 38 and is pivotable around a shaft 39 for vertical movement of the roll 35. The lever 38 is further connected to a piston rod 41 extending through a hydraulic cylinder 40 and is swingable about the shaft 39 by adjusting a flow rate of a liquid supplied to the cylinder 40 by a servo valve 42. The swinging movement of the lever 38 causes the arm 36 connected thereto to swing, thereby vertically moving the pressure roll 35. The opening of the servo valve 42 is adjusted as follows: Based on the reaction force of the workpiece 30 detected by the load cell 37, a tension T of the workpiece 30 is obtained by a tension computing element 46 and is compared with a preset tension value $T_{ref}$ by a comparator or adder-subtractor 45 to obtain a deviation $\Delta T$ therefrom. The deviation $\Delta T$ is multiplied by a coefficient $K_T$ in a coefficient multiplier 44 and is used to control the servo valve 42 through a servo amplifier 43 such that the deviation $\Delta T$ becomes zero.

According to the tension controllers 33 and 34 in FIG. 4, any change of the roll gap causes a resultant tension fluctuation which is detected by the load cell 37 on the bearing for the pressure roll 35. In order to equalize this with the desired value $T_{ref}$, inflow and outflow of the fluid into and from the hydraulic cylinder 40 is adjusted by the highly responsive servo valve 42 so that the pressure roll 35 is vertically moved and the tension of the workpiece 30 is promptly varied. Accordingly, any roll gap change in the hydraulic roll-gap control instantly influences the exit side thickness of the workpiece 30 so that highly responsive thickness control can be effected in comparison with the conventional tension control through motor current. In the system of FIG. 3, the reel-motor tension controller 18 and 29 suppress slower tension fluctuation and the tension controllers 33 and 34 absorb faster tension fluctuation.

Figure 2:
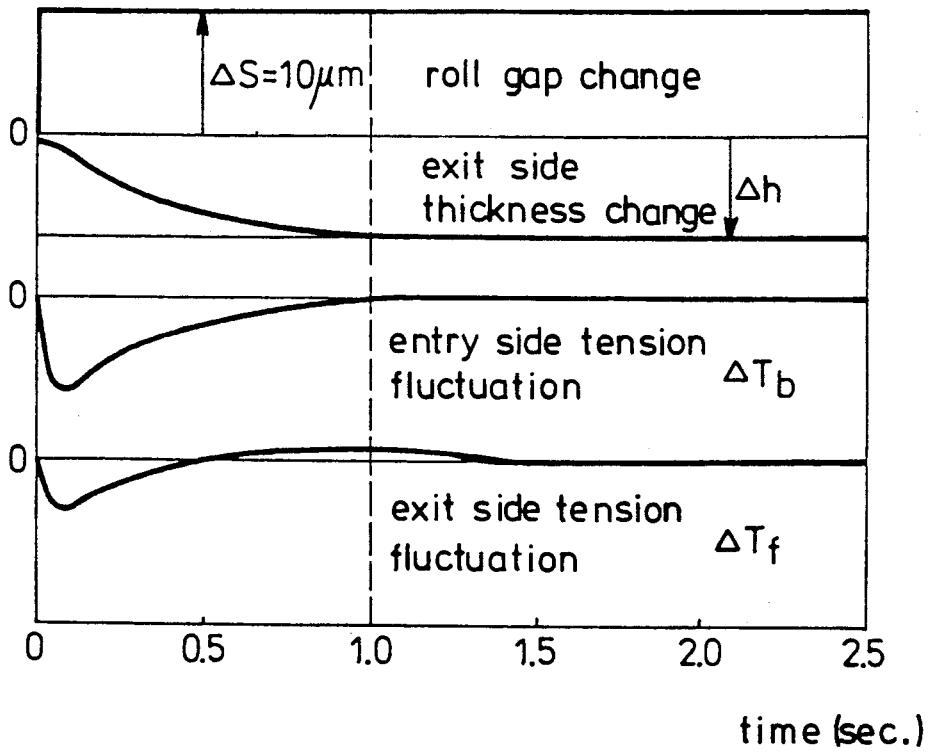
FIG. 2 is a diagram showing results of computer simulation for the system of FIG. 1.
Figure 5:
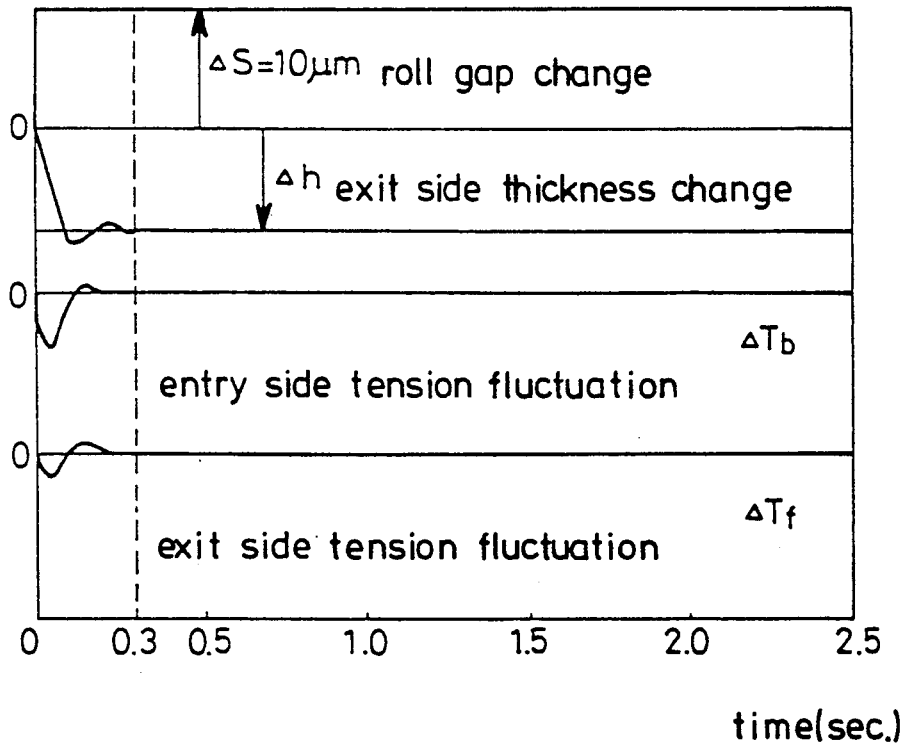

FIG. 5 shows a simulation example in which the response of the reel-motor tension controller 18 and 29 on the entry and exit sides of the rolling mill 32 in FIG. 1 is assumed to be higher by three times under the same conditions as in FIG. 2. When roll gap is decreased stepwise by 10 μm, the exit side thickness $\Delta h$ reaches a steady value after about 0.3 second, i.e., by three times as quickly as the simulation example in FIG. 2.

The tension controllers 33 and 34 in FIG. 4, which are responsive at the speed as high as the hydraulic roll-gap control, can suppress the tension fluctuations at higher speed than the simulation example in FIG. 5 to thereby control the thickness of the workpiece.

Figure 6:
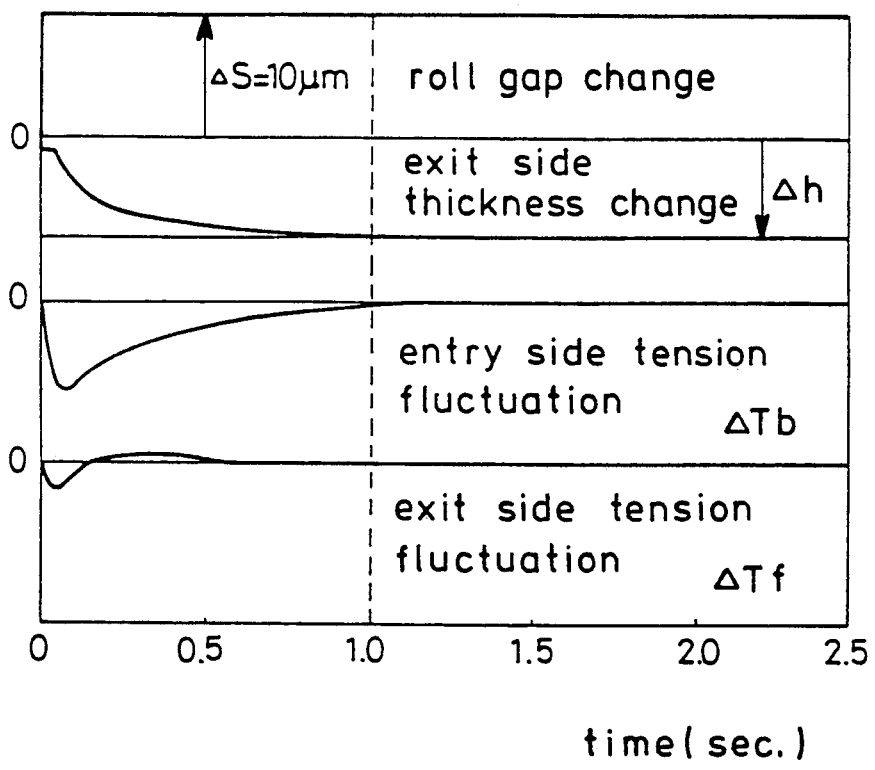

FIG. 6 is a simulation example of a case where, in the rolling mill of FIG. 1, the response of only the exit side reel-motor tension controller 29 is assumed to be higher by three times whereas the response of the entry side reel-motor tension controller 18 is the same as in FIG. 2. On the contrary, FIG. 7 is a simulation example of a case where the response of only the entry side tension controller 18 is assumed to be higher by three times while the response of the exit side tension controller 29 is left the same as in FIG. 2.

Figure 7:
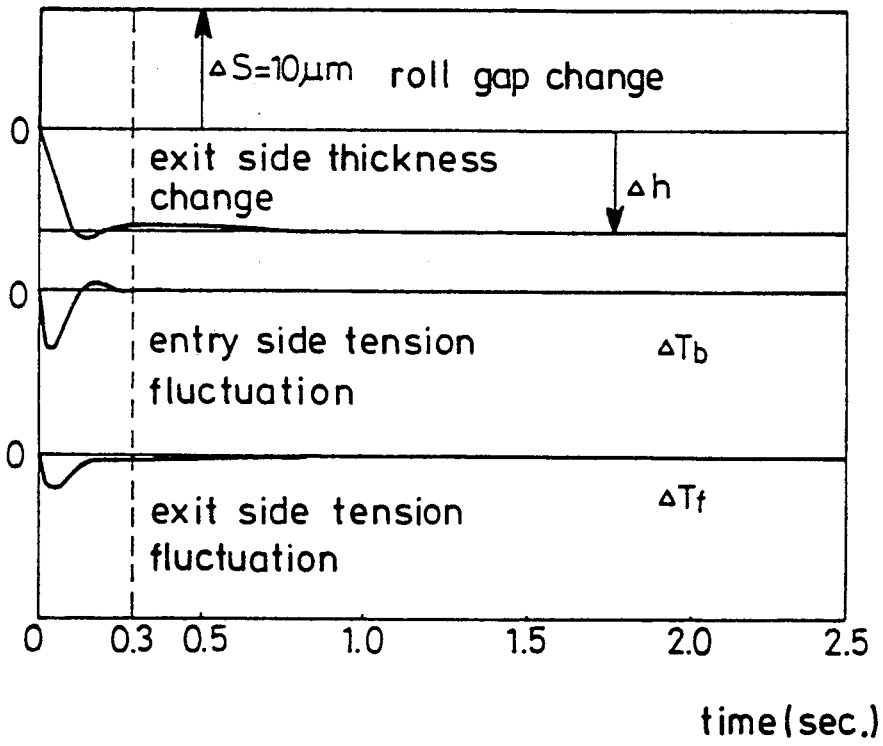

As is evident from FIGS. 6 and 7, controlling at quick response time of only the entry side tension controller, which will exert greater influence on the workpiece than the exit side tension controller, will attain substantially the same effects as quick controlling of both the entry and exit sides tension controllers in FIG. 5. This means that, as to the entry and exit side controllers 33 and 34 in the embodiment of FIG. 3, control of only the entry side one 33 will suffice for attaining enough effects in the case of the rolling direction shown. Therefore, though a reversible rolling mill will require tension controllers on opposite sides of the mill for its reversibility in rolling direction, only an entry side tension controller will suffice for non-reversible rolling mill for effecting rolling in only one direction.

Second Embodiment

Figure 8:
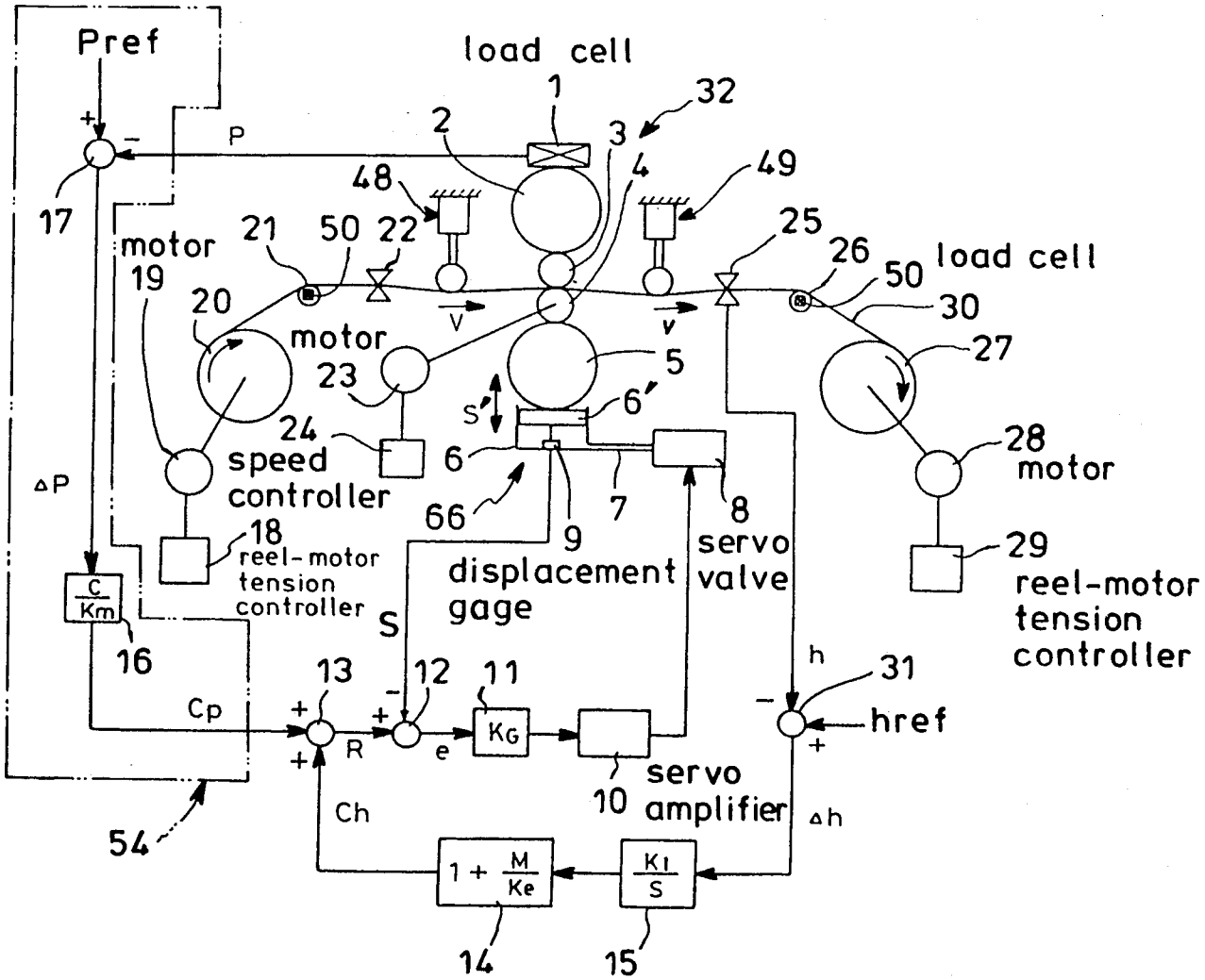
FIG. 8 is a general block diagram showing a system of a second embodiment of the present invention.

FIG. 8 shows a second embodiment of the present invention in which load cells 50 on bearings for the deflector rolls 21 and 26 detect tensions on the workpiece 30. Based on the detected tensions, tension controllers 48 and 49 adjust depression of the pressure roll 35 (see FIG. 9) to control the tension of the workpiece 30. The same components as in the first embodiment shown in FIGS. 3 and 4 are referred to by like numerals.

Figure 9:
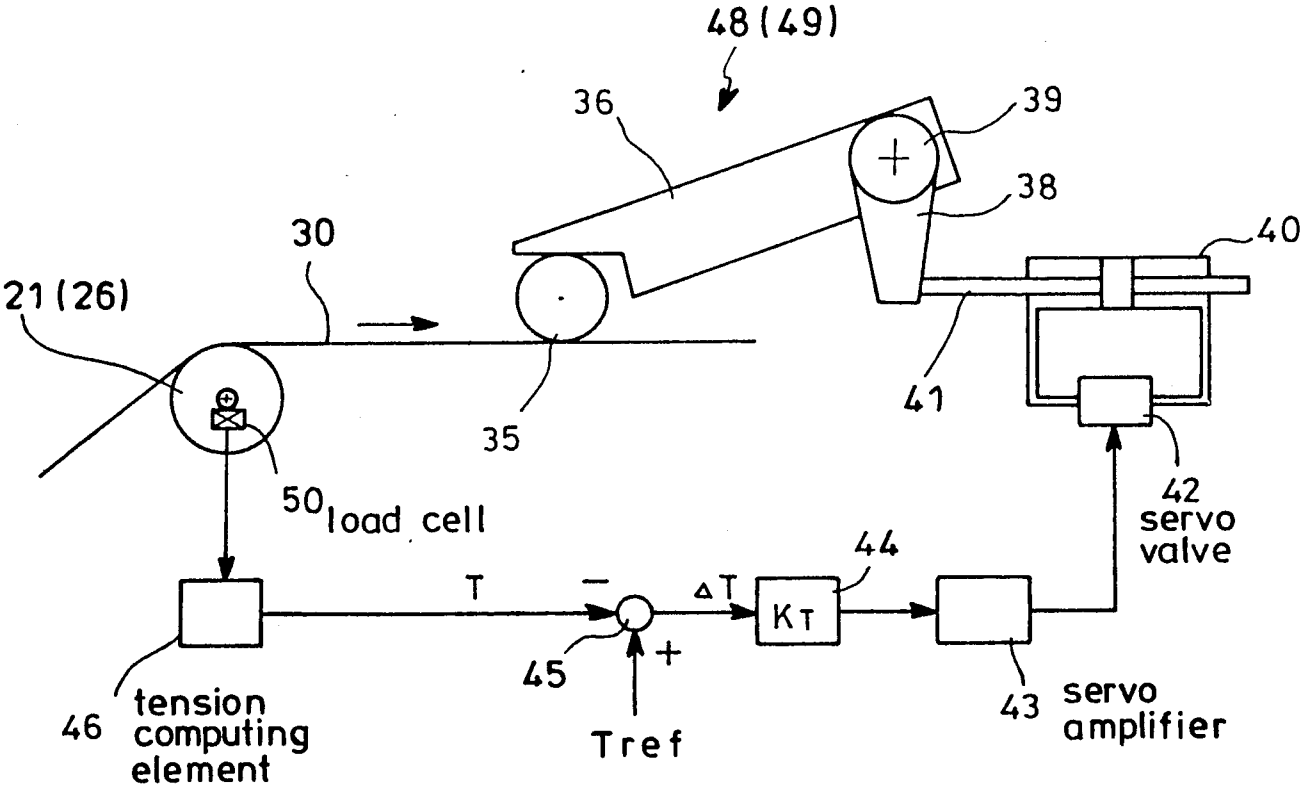
FIG. 9 is a specific example of the tension controllers 48 and 49 in FIG. 8.

FIG. 9 shows an example of the tension controllers 48 and 49 in FIG. 8 which are substantially similar to the controllers 33 and 34 in the first embodiment shown in FIGS. 3 and 4 except that, in stead of the load cell 37 for the pressure roll 35, a load cell 50 is mounted on each of the bearings for the deflector rolls 21 and 26 to detect the reaction force from the workpiece 30.

According to the tension controller 48 (49) of FIG. 9, when roll gap is changed, the resultant tension fluctuation is detected by the load cell 50 on the bearing for the deflecltor roll 21 (26). To equalize this with the desired value $T_{ref}$, inflow and outflow of the fluid into and out of the hydraulic cylinder 40 is adjusted by the highly responsive servo valve 42 so that the pressure roll 35 is vertically displaced to instantly change the tension on the workpiece 30. Accordingly, any roll gap change by the hydraulic roll-gap control promptly influences the exit side thickness of the workpiece 30. As in the case of the first embodiment, the tension controllers 48 and 49 are combined with the conventional reel-motor tension controllers using motor current to thereby achieve highly responsive thickness control.

Third Embodiment

Figure 10:
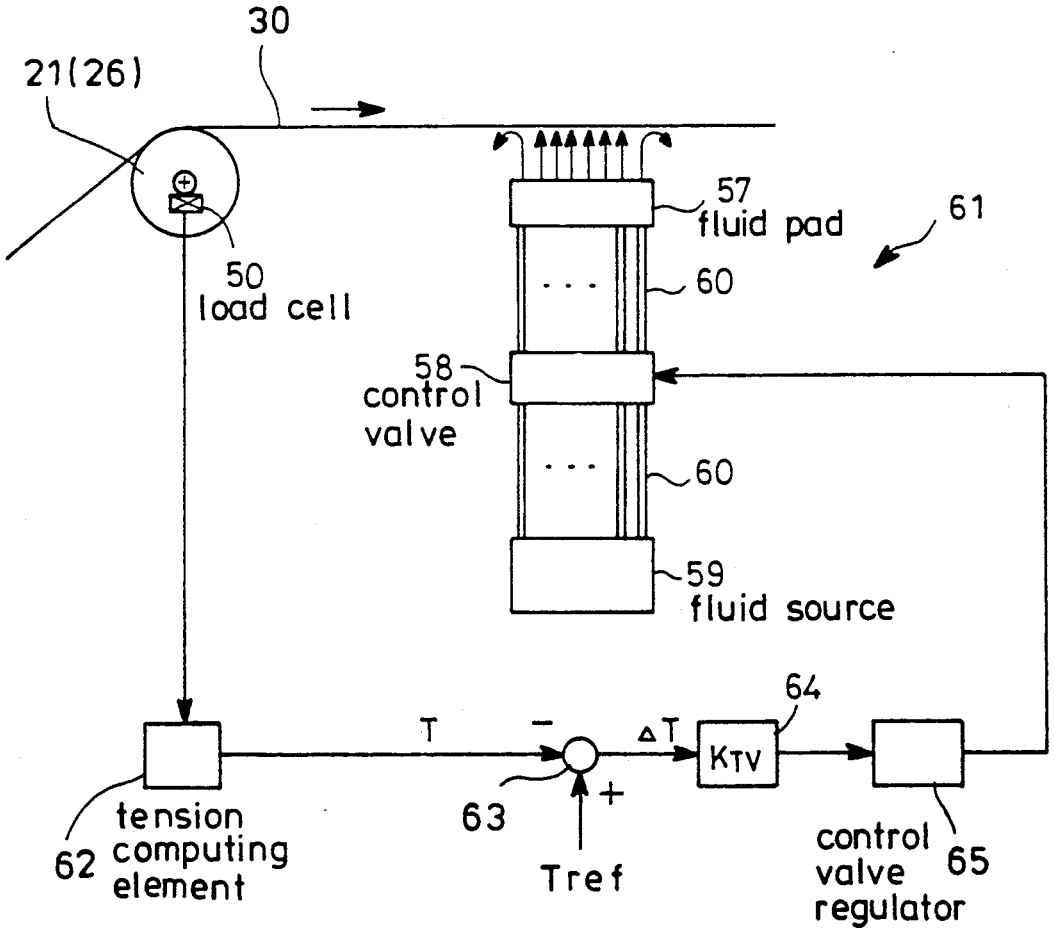
FIG. 10 is a specific example of the tension controller of a third embodiment of the present invention.

FIG. 10 shows a third embodiment of the present invention in which a tension controller 61 is provided by a fluid film instead of pressure roll and comprises a fluid pad 57, a control valve 58, a fluid source 59 and pipings 60 for connecting these components. The components as in the first and second embodiments above are referred to by like numerals.

The fluid pad 57 injects the fluid in the form of film from the source 59 through the valve 58 to a lower surface of the workpiece 30, supports the workpiece 30 by its pressure and gives tension to it. The load cell 50 on the bearing for the deflector roll 21 (26) detects the reaction force from the workpiece 30.

The detection output of the load cell 50 is inputted into a tension computing element 62 to obtain a tension T on the workpiece 30. The tension T thus obtained is compared with the tension reference value $T_{ref}$ by a comparator or adder-subtractor 63 to obtain a deviation $\Delta T$ therefrom. The coefficient multiplier 64 multiples this deviation $\Delta T$ with a coefficient $K_{TV}$ and inputs it into a control valve regulator 65 which regulates the opening of the control valve 58 based on the input signal and quantitatively controls the fluid injected from the fluid pad 57. More specifically, in a case where the detected tension T is smaller than the tension reference value $T_{ref}$, the control valve 58 is opened to increase the fluid flow rate to increase the tension. On the contrary, if the detected tension T is greater than the tension reference value $T_{ref}$, the control valve 58 is throttled to decrease the fluid flow rate to decrease the tension. In this way, the tension applied on the workpiece 30 is controlled by the pressure of fluid membrane so that the deviation $\Delta T$ becomes zero.

Fourth Embodiment

Figure 11:
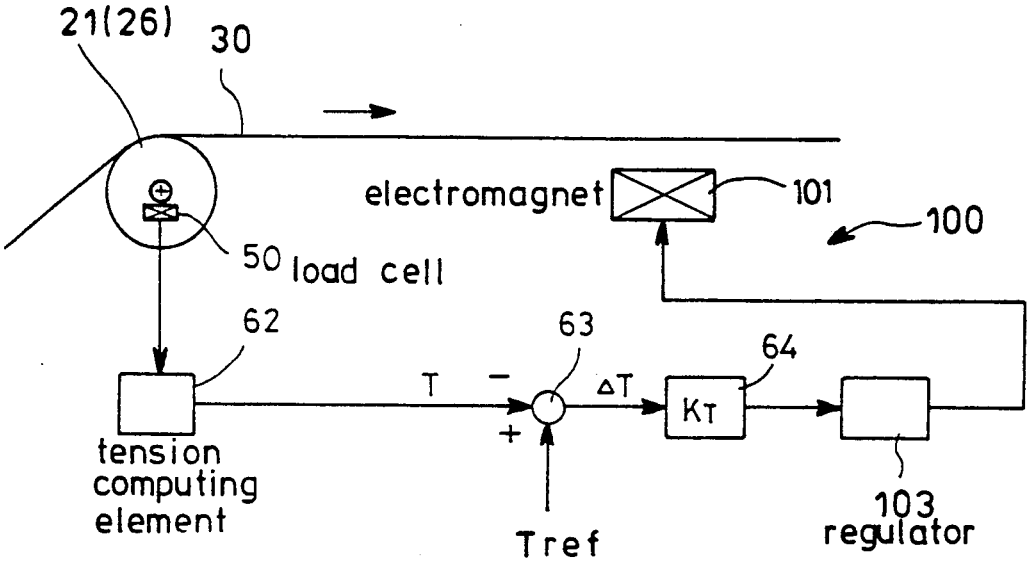
FIG. 11 is a block diagram showing a specific example using electromagnet or linear motor as the tension controller of a fourth embodiment of the present invention.

This is a case where a tension controller 100 uses suction force of an electromagnet 101 in FIG. 11, a workpiece to be rolled being limited to ferromagnetic material such as iron. The components as in FIG. 10 are referred to by like numerals. Reference numeral 103 designates a regulator of electromagnetic output. The electromagnet 101 is driven in accordance with a deviation $\Delta T$ of the detected tension T from the tension reference value $T_{ref}$ to generate vertical suction force on the workpiece 30 for tension control. Instead of the electromagnet 101, linear motors may be displaced above and below the workpiece to give tension on the workpiece by suction or reaction force. In such a case, the workpiece is limited to electrically conductive material.

With regard to FIGS. 5, 6, 7 and 2, it has been described that the response of thickness control can be improved by speeding up the response in tension control. In the following, more description is given to elucidate the performances of the tension controllers of the present invention.

Figure 12:
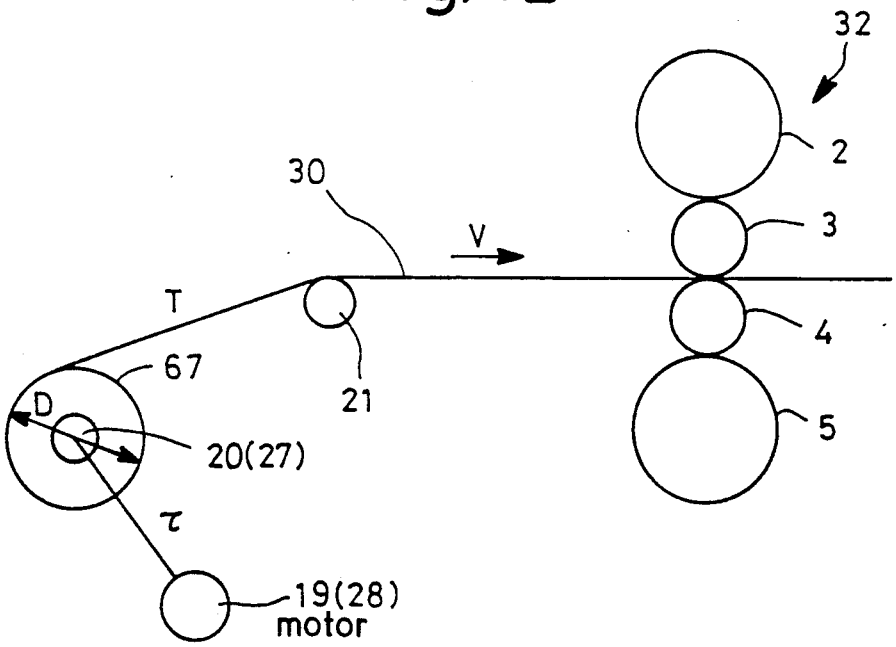
FIG. 12 is a diagram to explain the tension control principle of the reels 20 and 27.

FIG. 12 is to explain the principle of the tension controllers for the reels 20 and 27. A torque $\tau$ of the motor 19 (28) required for generating a tension T of a coil 67 when a radius of the coil 67 is D is in proportion to product of D with T and is given by:

$$\tau \propto T \cdot D \quad (1)$$

On the other hand, an output torque of the motor 19 (28) is expressed by:

$$\tau \propto i \cdot \phi \quad (2)$$

From (1) and (2)

$$T \propto i \cdot (\phi/D) \quad (3)$$

where i represents motor current and $\phi$, motor field magnetic flux. If control is made such that the coil radius D becomes proportional to motor field magnetic flux $\phi$, $(\phi/D)$ takes a constant value and the tension T is proportional to motor current i. Thus, in the tension control for the reels 20 and 27, the coil radius D is made proportional to motor field magnetic flux $\phi$ and the required tension T is obtained by setting motor current. This is the conventional tension control for the reels 20 and 27 during steady rolling where rolling speed after acceleration has become constant.

As shown in FIG. 2, with the conventional tension control, any roll gap change will result in change of the exit side thickness only in a response time of tension control since the reels 20 and 27 has great inertia and the response of the tension control is slow. Accordingly, the thickness accuracy cannot be improved in high response hydraulic roll-gap control.

Figure 13:
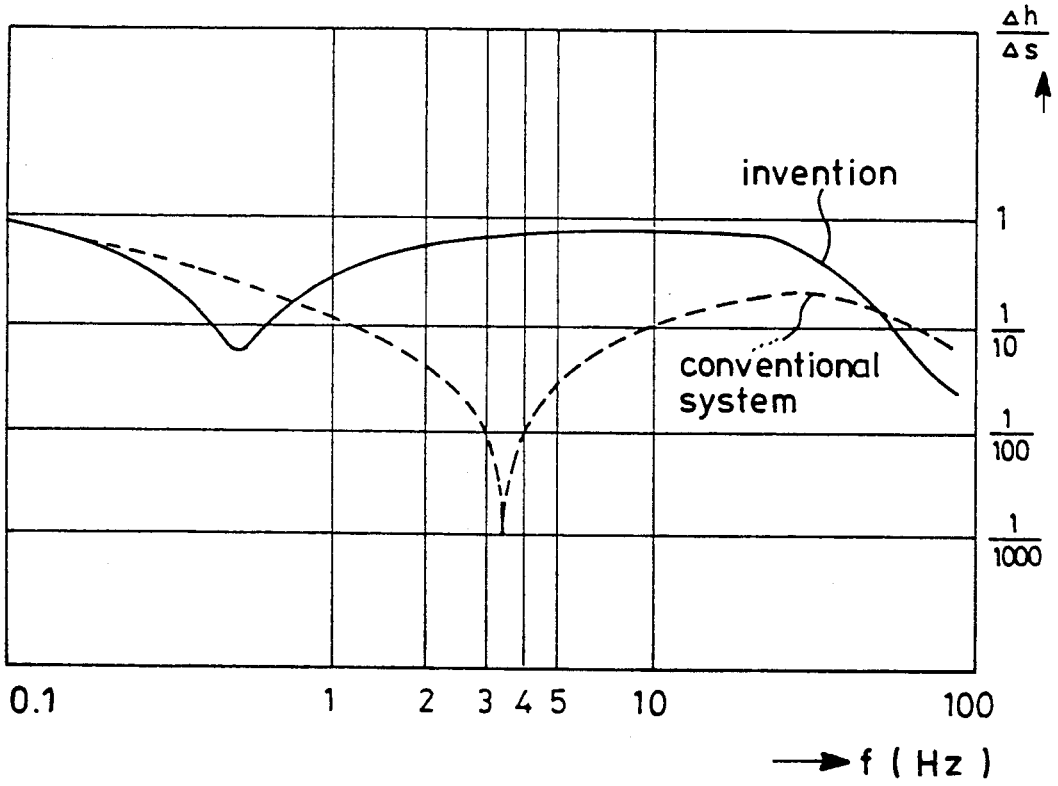
FIG. 13 is a block diagram showing influence on the exit side thickness Δh when the roll gap ΔS is changed.

FIG. 13 shows Bode diagram of the influence on the exit side thickness $\Delta h$ when roll gap $\Delta S$ is changed. Dotted line shows a case where a conventional tension controller is used while a solid line represents a case where the tension controller of the present invention (e.g., the part 48 in FIG. 9) is disposed on the entry side of the rolling mill. In the conventional example shown by the dotted line, the influence of roll gap $\Delta S$ is attenuated even to 1/10000 at 3.75 Hz. As described later, this sharp downward peak occurs due to the inertia of the reel 20 (27) and to the resonance by spring constant of the workpiece 30. By contrast, with the present invention as shown by solid line, the downward peak is deviated toward lower frequency and the peak attenuation is decreased to about 1/10. At 2–10 Hz, the characteristic becomes perfectly flat into $\Delta h/\Delta S \approx 1$ and the roll gap $\Delta S$ is influenced on the thickness $\Delta h$.

Figure 14:
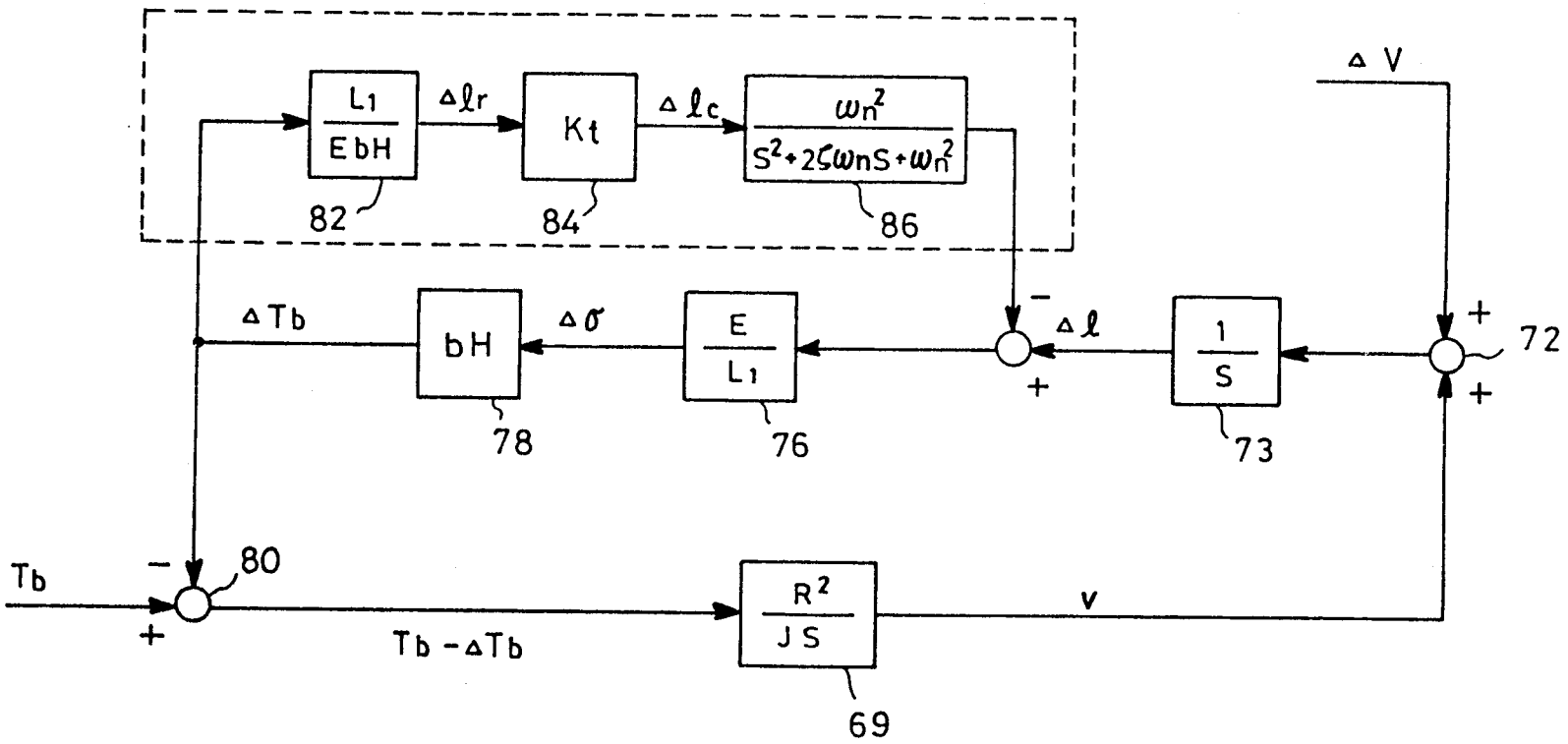
FIG. 14 is a block diagram to explain performance of the tension controller of the present invention.

FIG. 14 shows a block diagram to explain the performances or functions of the tension controller of the present invention. The controller is omitted because of its quick response. A zone within the dotted line expresses characteristics of the tension controller according to the present invention and the remainder, physical phenomena during the rolling operation. Symbols used are E. Young's modulus of workpiece,
b: workpiece width,
H: workpiece thickness;
$L_1$: distance between rolling mill and reel,
J: inertia moment of reel including coil,
R: coil radius (=D/2),
$K_t$: gain of tension controller,
S: Laplace operator, $\Delta V$: rolling speed variation and $\Delta T_b$: backward tension fluctuation.

Using this block diagram, explained are generation of actual tension fluctuation during a rolling operation and function or performances of the tension controller of the present invention. First, the reel 20 (27) including the coil 67 (see FIG. 12) is accelerated by the tension value $T_b$ which is proportional to motor current value from a current controller (not shown) to generate a peripheral speed v of the reel at block 69. The reel peripheral speed v is disturbed by a speed change $\Delta V$ of the workpiece 30 due to tension fluctuations on the entry and exit sides of the mill 32 and/or due to the thickness variation of the workpiece 30, which will causes speed unbalance through an adder 72. This is integrated (by the integrator 73) into an elongation difference $\Delta 1$ in the longitudinal direction of the workpiece 30 from which the tension stress change $\Delta\sigma$ is calculated at block 76. The calculated tension stress change $\Delta\sigma$ is multiplied with bH at block 78 so that the backward tension fluctuation $\Delta T_b$ is obtained which is compared with the tension value $T_b$ in the adder 80 to obtain the deviation $T_b-\Delta T_b$. Thus, the reel 20 (27) is driven by the deviation $T_b-\Delta T_b$ to compensate the influence of $\Delta V$. The compensatory response is slow as already mentioned because of great inertia of the reel 20 (27) as shown in block 69. These are acutal generation of tension fluctuation during a rolling operation and conventional tension fluctuation compensation by the reel 20 (27). By contrast. according to the tension control system of the present invention, the tension fluctuation $\Delta T_b$ is detected and is multiplied with conversion coefficient given by block 82 into an elongation change $\Delta l_r$. The elongation change $\Delta l_r$ is multiplied with control gain $K_t$ in block 84 to obtain the control quantity $\Delta l_c$ to be used for tension control. As is evident from FIG. 14, the response is quick as the inertia of the reels (block 69) is not involved.

When the characteristics within the dotted line of FIG. 14 are not taken into account, transfer function from $\Delta V$ to $\Delta T_b$ is obtained in terms of the following equation:

$$\frac{\Delta T_b}{\Delta V} = \frac{\dfrac{S}{\left(\dfrac{R^2}{J}\right)}}{\dfrac{S^2}{\left(\dfrac{EbH}{L_1}\right)\left(\dfrac{R^2}{J}\right)} + 1} \tag{4}$$

From the equation (4), resonance frequency $\omega_n$ is obtained as:

$$\omega_n = \sqrt{\left(\frac{EbH}{L_1}\right)\left(\frac{R^2}{J}\right)}$$

and this value was 3.75 Hz in the conventional system shown by the dotted line in FIG. 13.

Next, the transfer function from $\Delta V$ to $\Delta T_b$ by considering the characteristics of the tension control system of the present invention within the dotted line is given as:

$$\frac{\Delta T_b}{\Delta V} = \frac{\dfrac{S}{\left(\dfrac{R^2}{J}\right)}}{\dfrac{S^2}{\left(\dfrac{EbH}{L_1}\cdot\dfrac{1}{1+K_t\cdot G}\right)\left(\dfrac{R^2}{J}\right)} + 1} \tag{5}$$

Here, G represents dynamic characteristic of tension controller (block 86 in FIG. 14) and $$G = \frac{\omega_n^2}{S^2 + 2\zeta\omega_n S + \omega_n^2}$$

From the equation (5), resonance frequency $\omega_n$ is given as:

$$\omega_n = \sqrt{\left(\frac{EbH}{L_1}\cdot\frac{1}{1+K_t\cdot G}\right)\left(\frac{R^2}{J}\right)} \tag{6}$$

Namely, the tension controller of the present invention serves to change Young's modulus of the workpiece 30 so that it deviates the resonance frequency $\omega_n$ caused by inertia of the reel 20 (27) and spring constant (Young's modulus) of the workpiece 30 to a region where no influence is exerted on thickness control. When a positive values is taken for $K_t$, the resonance frequency is deviated toward lower frequency than actual resonance frequency. If a negative value is taken, the resonance frequency is deviated toward higher frequency. In so doing, prevented is the phenomenon that tension be extensively varied by resonance of the reel 20 (27) and thickness be not changed even when roll gap is changed by rapid frequency as seen in the conventional system. Since the control on the roll gap directly influences the thickness, conventional thickness control modes such as feed forward AGC or BISRA (British Iron and Steel Research Association) AGC can be utilized effectively.

Fifth Embodiment

Figure 15:
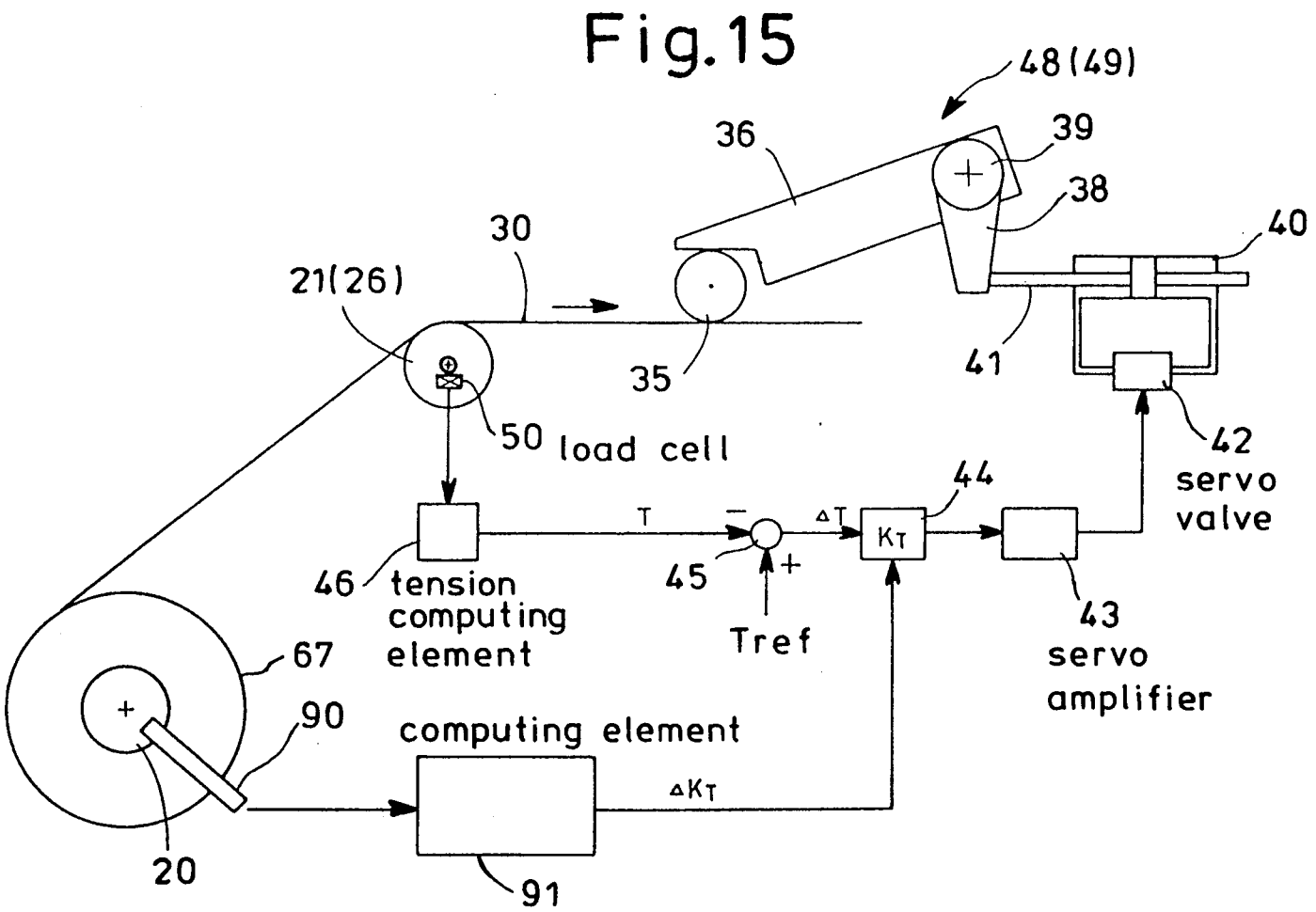
FIG. 15 is a block diagram showing a fifth embodiment of the present invention with control gain being corrected in accordance with coil radius.

FIG. 15 shows a development of the invention based on the above concept. As is evident from the equation (6), the inertia of a reel will alter as coil radius R is changed. In FIG. 15, the radius R is detected by, e.g., an optical sensor 90. Based on the sensed value, a computing element 91 obtains a correction value $\Delta K_t$ of the control gain $K_t$ and the control gain $K_t$ is changed accordingly.

Sixth Embodiment

Figure 16:
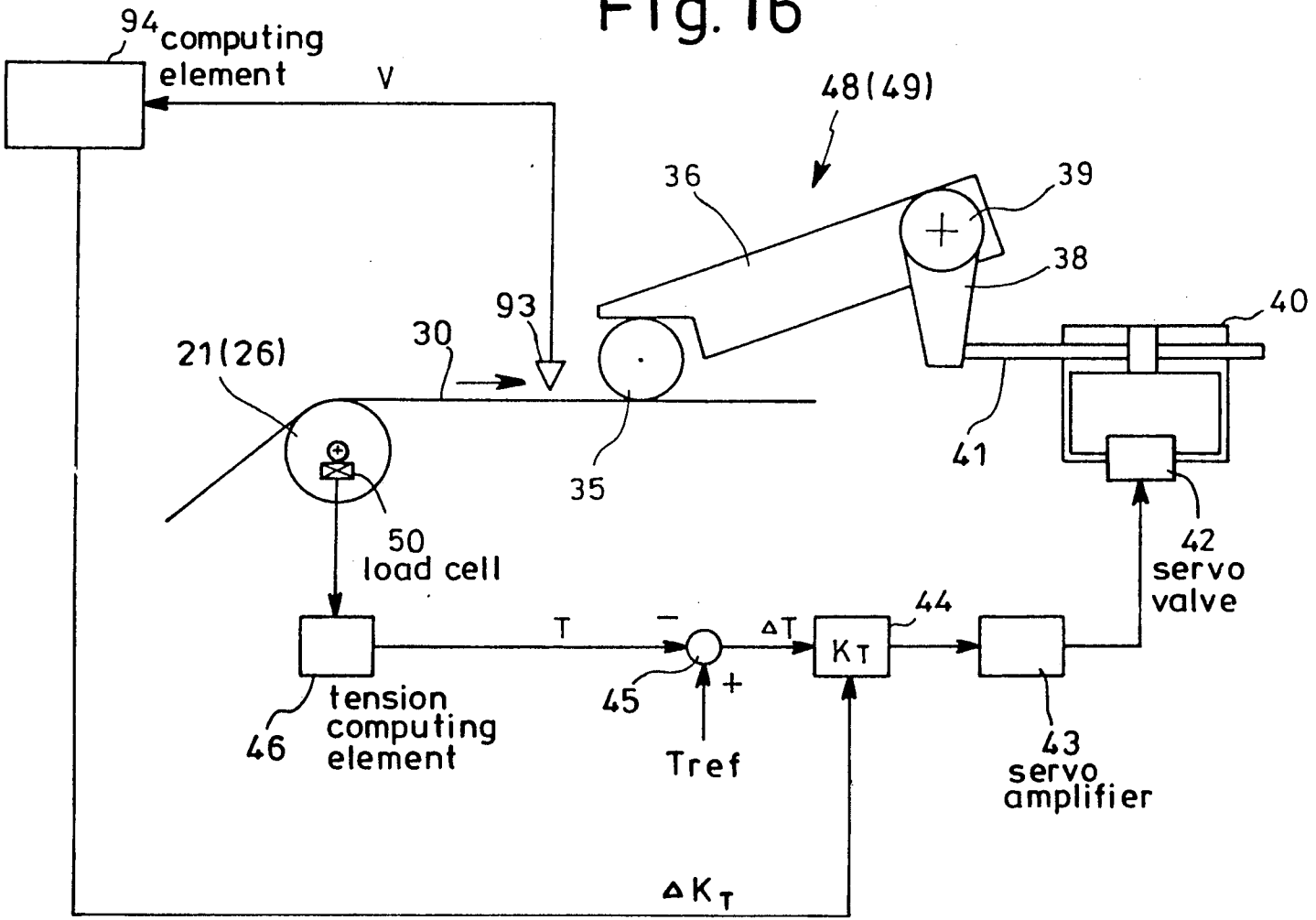
FIG. 16 is a block diagram showing a sixth embodiment of the present invention with the control gain being corrected in accordance with mill speed.

FIG. 16 shows a further development of the invention in which the speed V of the workpiece 30 is detected by a detector 93. Based on the detected speed, a frequency of entry side thickness disturbance is calculated to obtain a required value $\omega_n$ from which a correction quantity $\Delta K_t$ of the control gain required is calculated back, using the equation (6), by the computing element 94 to thereby change the control gain $K_t$.

Seventh Embodiment

When a rolling mill is hardened so as to eliminate any entry side thickness disturbance by mill modulus control, naturally the disturbances such a roll eccentricity generated by the mill itself tends to give influence on thickness, disadvantageously resulting in deterioration of the thickness accuracy. To solve this problem, conventionally a so-called roll eccentricity elimination controller has been practically used in which the roll eccentricity is obtained from e.g. a rolling pressure signal and on the basis of the obtained roll eccentricity the roll gap is corrected by moving it to the direction reverse to the eccentricity movement. However, this method cannot eliminate well the influence of eccentricity upon higher-speed rolling since the variation period of roll eccentricity is too quick to be responsive to hydraulic roll-gap control.

Figure 17:
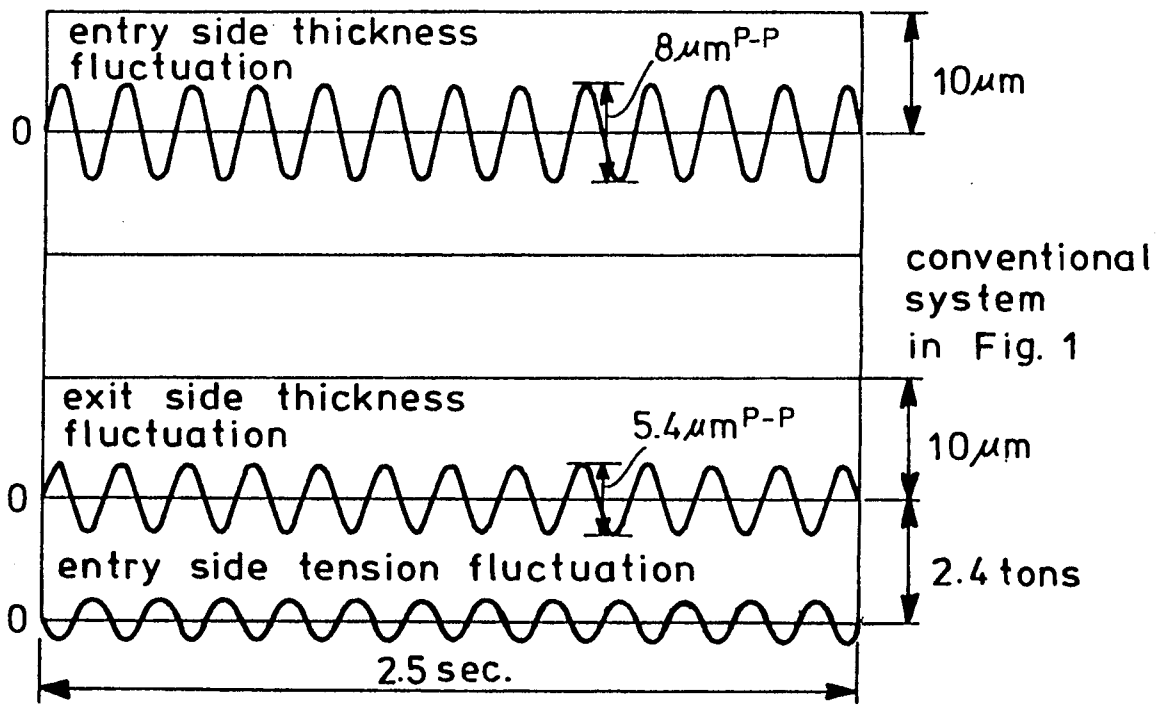
FIG. 17 is a diagram showing results of computer simulation for exit side thickness change and entry side tension fluctuation to entry side thickness change.
Figure 18:
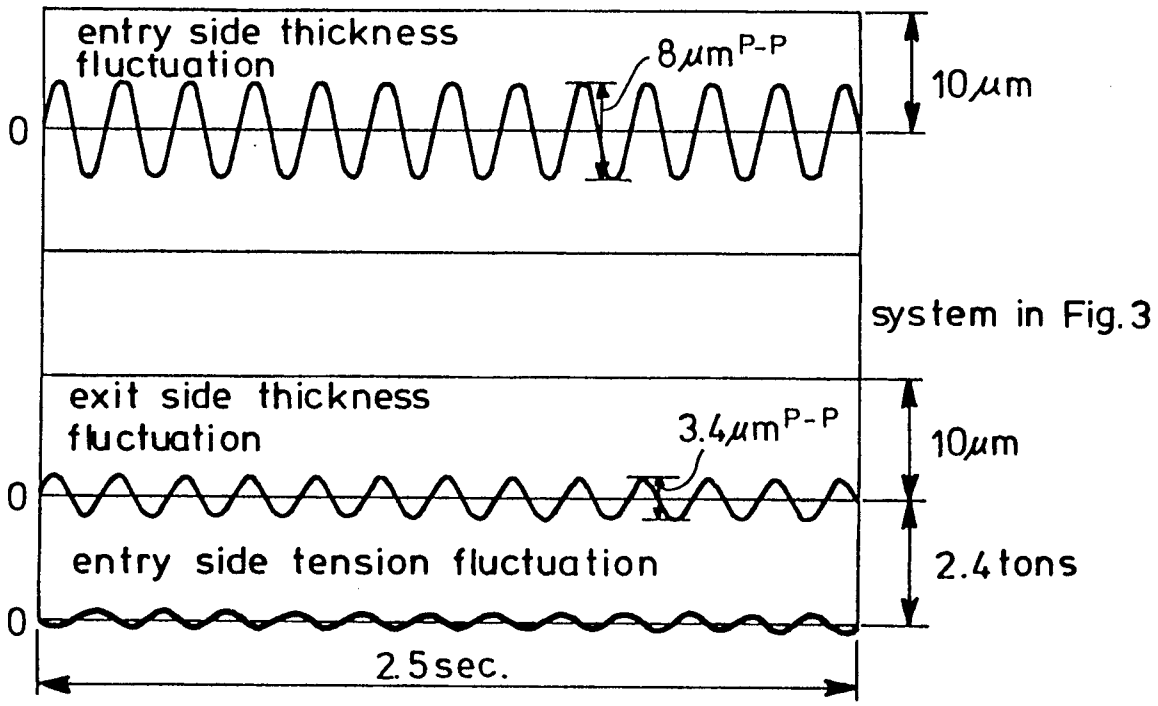
FIG. 18 is a diagram showing results of computer simulation for exit side thickness change and entry side tension fluctuation to entry side thickness change in the system of FIG. 3.

FIGS. 17 to 20 show results of computer simulation which the inventor performed to review the above problems. The simulation was performed on a single stand cold rolling mill as shown in FIGS. 1 and 3. Under the conditions that the workpiece having entry side thickness of 0.28 mm, width of 1800 mm, entry side setting tension of 1.42 tons and exit side setting tension of 3.04 tons was rolled to the desired thickness of 0.2 mm at rolling speed of 1800 m/min., calculation was made under the assumption that entry side thickness disturbance includes the amplitude of $\pm 4$ $\mu$m and fluctuating frequency of 5 Hz and roll eccentricity includes the amplitude of $\pm 3$ $\mu$m and fluctuating frequency of 6.53 Hz. FIGS. 17 and 18 represent cases where study was made only on the influence of entry side thickness fluctuation.

FIG. 17 shows a case where mill modulus is made by ten times harder by mill modulus control in the conventional rolling mill 32 in FIG. 1 and exit side thickness fluctuation is 5.4 $\mu m^{P-P}$ to the entry side thickness fluctuation of 8 $\mu m^{P-P}$. In the system according to the present invention having the tension controller 33 on the entry side of the rolling mill as shown in FIG. 3, the exit side thickness fluctuation can be decreased to 3.4 $\mu m^{P-P}$ as is evident from FIG. 18. This is because entry side thickness fluctuation can be decreased by hardening the mill by mill modulus control as the entry side tension fluctuation can be suppressed by the tension controller 33.

Figure 19:
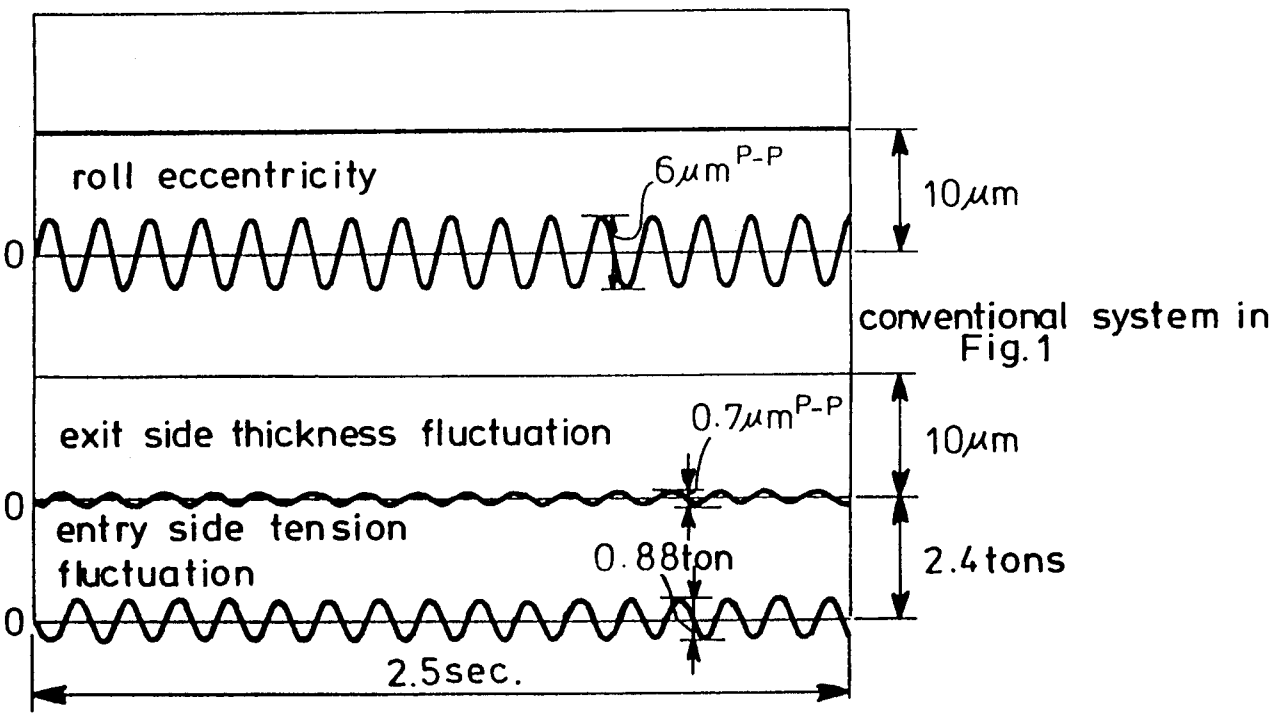
FIG. 19 is a diagram showing results of computer simulation of exit side thickness change and the entry side tension fluctuation to roll eccentricity in the conventional system of FIG. 1.
Figure 20:
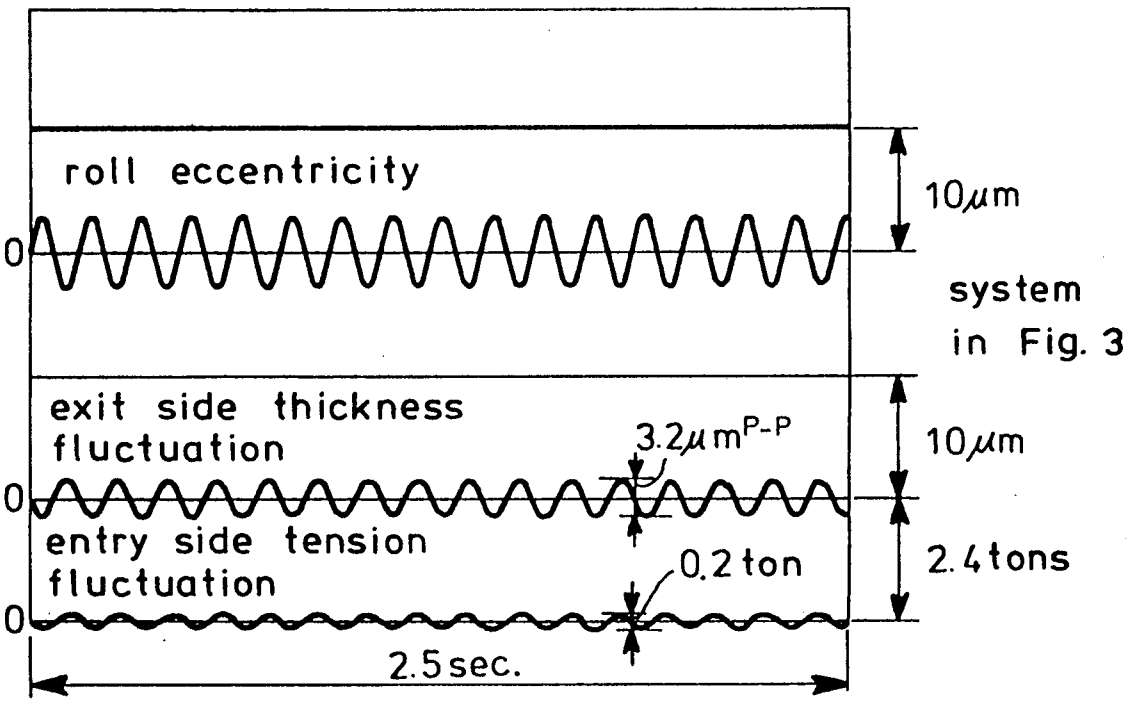
FIG. 20 is a diagram showing results of computer simulation of exit side thickness change and entry side tension fluctuation to roll eccentricity in the conventional system of FIG. 1.

By contrast, FIGS. 19 and 20 represent cases where study was made only on the influence of roll eccentricity.

FIG. 19 shows a case where mill modulus is made by ten times harder by mill modulus control in the conventional rolling mill 32 in FIG. 1 and where roll eccentricity of 6 $\mu m^{P-P}$ did not induce the exit side thickness fluctuation almost at all. As to the entry side tension fluctuation, the tension is fluctuated to as high as 0.88 $ton^{P-P}$ so that roll eccentricity exerts almost no influence on thickness. On the contrary, when the tension controller 33 is disposed on the entry side of the rolling mill 32, as shown in FIG. 20, the entry side tension fluctuation is extensively decreased to 0.2 $ton^{P-P}$ so that the exit side thickness fluctuation is increased up to 3.2 tons $\mu m^{P-P}$. In other words, suppression of the entry side tension fluctuation will cause the change of roll gap due to roll eccentricity to exert influence on the thickness of the workpiece.

The above result reveals that, when the tension controller 33 and 34 are disposed on the entry side or on both the entry and exit sides to adjust tension or tensions applied on the workpiece 30, both of factors attributable to the workpiece itself such as entry thickness disturbance and factors attributable to the machinery such as roll eccentricity are to be taken into consideration.

Figure 21:
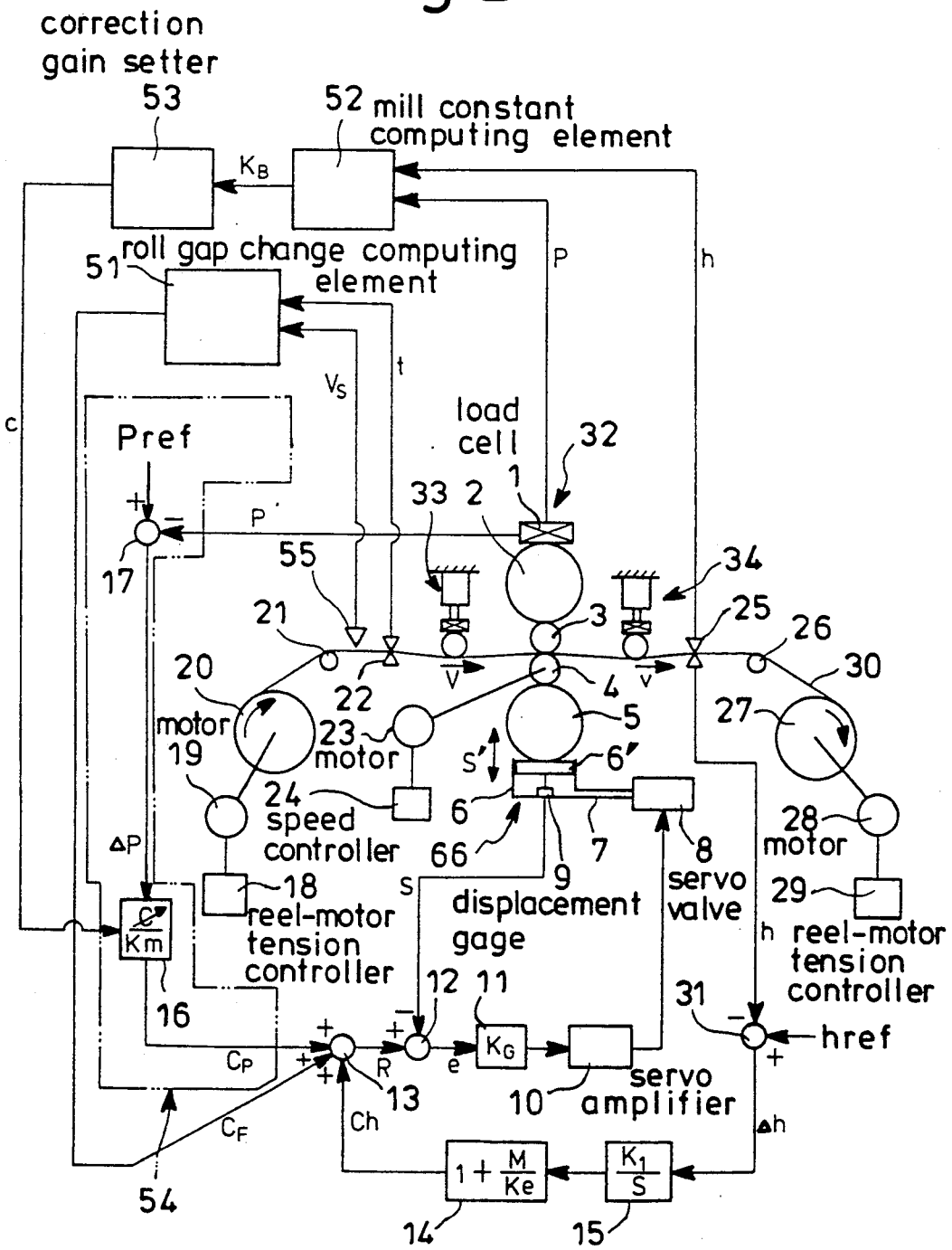
FIG. 21 is a general block diagram showing a system of a seventh embodiment of the present invention.

FIG. 21 is a general block diagram showing a seventh embodiment of the present invention. The components as shown in FIG. 3 are referred to by like numerals.

As shown in FIG. 21, the tension controllers 33 and 34 to adjust tensions applied on the workpiece 30 are disposed on the entry side or on both the entry and exit sides of the rolling mill 32. The thickness gage 22 to detect thickness of the workpiece 30 and the speed detector 55 to detect the feeding speed V of the workpiece 30 are disposed on the entry side of the rolling mill 32. Also, the thickness gage 25 to detect thickness of the workpiece 30 is disposed on the exit side of the rolling mill 32.

Based on a signal t from the thickness gage 22 on the entry side, a roll gap change computing element 51 calculates a roll gap change quantity to counterbalance the entry side thickness disturbance. Based on a signal $V_S$ from the speed detector 55, the computing element 51 calculates a timing to change the roll gap, i.e., the timing where the entry side thickness disturbance passes between the work rolls 3 and 4 of the rolling mill 32. The computing element 51 transmits, as instruction in the basic position control, a roll gap change signal $C_F$ representative of the calculated quantity to the adder 13 at the calculated timing.

Further, a mill modulus computing element 52 is disposed by which an output signal P representative of the rolling pressure from the load cell 1 and/or a signal h representative of the exit side thickness from the thickness gage 25 on the exit side is analyzed to obtain a frequency component of the exit side thickness fluctuation and based thereon calculates an optimal mill modulus. A mill modulus signal $K_B$ representative of the optimal mill modulus is transmitted from the computing element 51 to a correction gain setter 53 which obtains a correction gain on the basis of the signal $K_B$ and outputs a correction gain signal c to the mill modulus control unit 54.

Next, description is given on the operation of the above embodiment.

The tension controllers 33 and 34 measure tension fluctuations on the workpiece 30 and moves the pressure roll 35 as shown in FIG. 4 to decrease the fluctuations. Accordingly, the tension fluctuations due to roll gap change is quickly suppressed and the roll gap change influences the exit side thickness.

Further, entry side thickness fluctuation is measured by the thickness gage 22 on the entry side of the rolling mill 32 and the feed speed V of the workpiece 30 is measured by the speed detector 55. Based on the signals t and $V_S$ respectively from the thickness gage 22 and the speed detector 55, the roll gap change quantity and the timing of the entry side thickness fluctuation passing between the upper and lower work rolls 3 and 4 of the rolling mill 32 are calculated by the roll gap change quantity computing element 51. The roll gap change quantity signal $C_F$ is outputted to the adder 13 of the basic position control loop. Thus, the roll gap between the work rolls 3 and 4 is adjusted and the entry side thickness fluctuation is eliminated. Also, based on the signal P from the load cell 1 and/or the signal h from the thickness gage 25 on the exit side, the frequency component of the exit side thickness fluctuation is obtained and optimal mill modulus for eliminating the influence of disturbance components caused by the rolling mill 32 itself such as roll eccentricity is obtained by the mill modulus computing element 52. Based on the mill modulus signal $K_B$ outputted from the mill modulus computing element 52, correction gain is obtained by the correction gain setter 53 which outputs the correction gain signal c on the basis of which in turn a correction gain of the coefficient multiplier 16 in the mill modulus control unit 54 is changed. There is no need to incorporate both the signal P from the load cell 1 and the signal h from the exit side thickness gage 25 in the mill modulus computing unit 52 and only one of them will suffice.

As shown in FIGS. 19 and 20, if roll eccentricity is the main cause of exit side thickness fluctuation, it is not desirable to harden the mill by mill modulus control since this aggravates the exit side thickness fluctuation. However, in the FIG. 21 embodiment, mill modulus is set by mill modulus control to make the mill softer more or less in the case where the influence of roll eccentricity is strong. Thus, exit side thickness fluctuation due to roll eccentricity is suppressed.

On the other hand, the setting of mill modulus by mill modulus control to make the mill softer more or less means stronger influence of entry side thickness disturbance on the exit side thickness fluctuation.

However, in the FIG. 21 embodiment, the entry side thickness fluctuation is measured by the thickness gage 22 on the entry side of the rolling mill 32 and the speed of the workpiece 30 is measured by the speed detector 55. The timing of the entry side thickness fluctuation passing between the work rolls 3 and 4 of the rolling mill 32 is obtained by the roll gap change quantity computing element 51 and the roll gap is changed from time to time in according therewith. Thus, the entry side thickness disturbance is suppressed and the influence of entry side thickness disturbance on exit side thickness fluctuation can be reduced.

Figure 22:
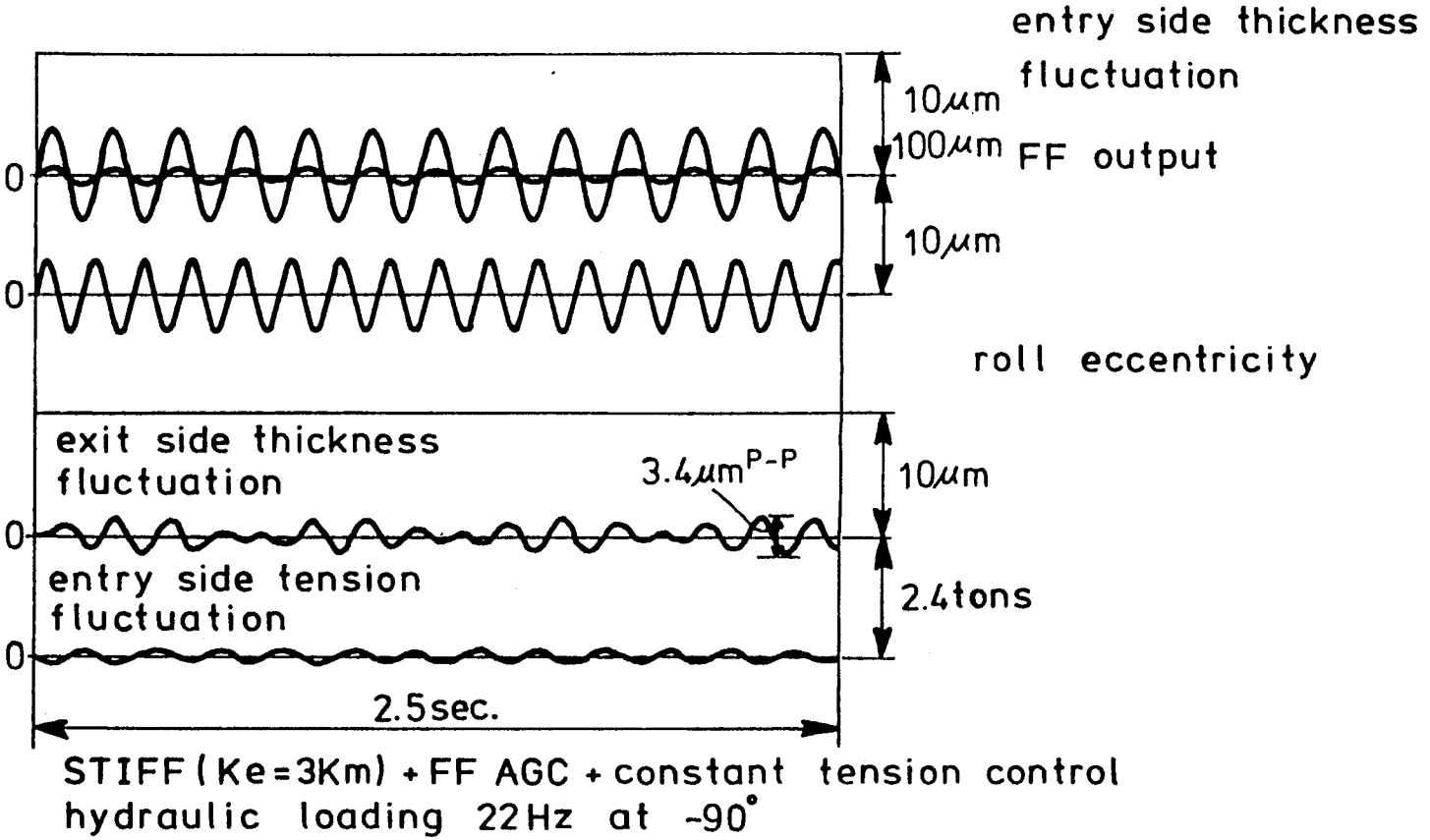
FIG. 22 is a diagram showing results of computer simulation in a case where mill modulus is increased by three times in the system of FIG. 21.
Figure 23:
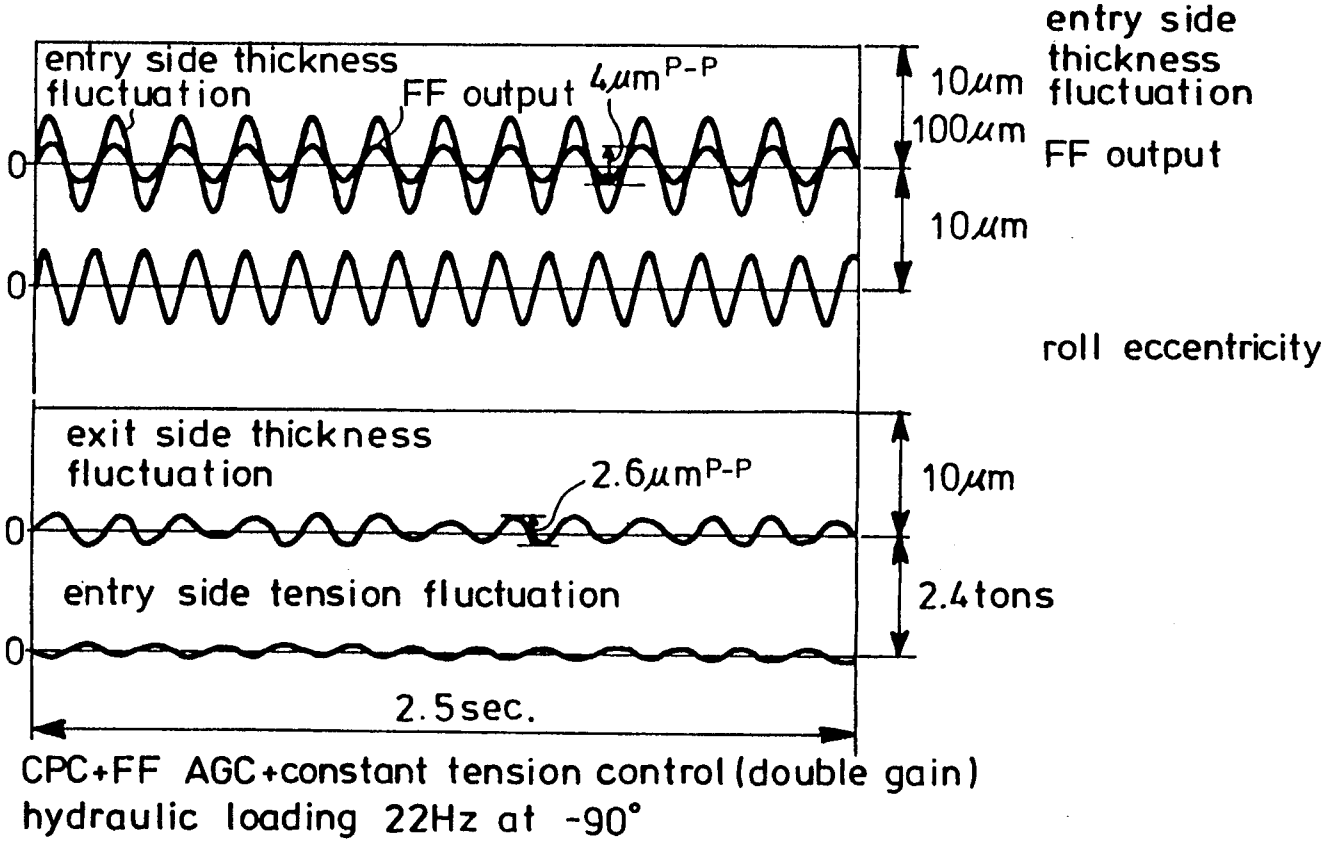
FIG. 23 is a diagram showing results of computer simulation in a case where natural mill modulus is used in the system of FIG. 21.

FIGS. 22 and 23 show results of computer simulations which was performed to show the effects of the embodiment of the present invention in a case where entry side thickness fluctuation and roll eccentricity are simultaneously involved as disturbances. The conditions are the same as in the case of FIGS. 17 to 20. FIG. 22 shows the case where mill modulus is increased by three times by mill modulus control in the FIG. 21 embodiment ($c=0.67$ when $Ke=Km/(1-c)$). FIG. 23 is a case where natural mill modulus is used ($c=0$). In FIG. 22, the exit thickness fluctuation is about 3.4 μm due to the influence of roll eccentricity whereas in FIG. 23 where mill modulus is set to optimal value, the fluctuation is decreased to about 2.6 μm and this exhibits the excellent effects of the present invention.

There is no need to calculate optimal mill modulus at all times and it may be enough to calculate the optimal mill modulus only once according to rolling pressure or exit side thickness and to preset the same.

In the above embodiments, description has been give on cases where the present invention was applied to a single stand reversible cold rolling mill; however, it is to be understood that the present invention may also be applied to a non-reversible rolling mill for rolling in one direction, a tandem rolling mill comprising two or more stands and any other type of rolling mills in which the problems described above with respect to the prior art may occur. The tension may be detected from the reaction force of the workpiece on a roll or other components on the running route of the workpiece in place of the pressure roll and deflector roll. Other modifications may be made without deviating the true spirit of the present invention.

As described above, the thickness control system for a rolling mill according to the present invention provides tension controllers on an entry side or on both entry and exit sides of a rolling mill so that any tension fluctuation on the entry side or on both the entry and exit sides due to change of a draft position of the mill for control of thickness of a workpiece is quickly suppressed. Furthermore, the entry side thickness disturbance is measured by a thickness gage on the entry side for elimination of the same and any influences of roll eccentricity and the like are suppressed by changing mill modulus through change of a correction gain so that response of thickness control is assumed to be higher to obtain product thickness with higher accuracy.

What is claimed is:

1. In a thickness control system for a rolling mill having a hydraulic roll gap control system for setting a roll gap between upper and lower work rolls for rolling a workpiece passing from an uncoiling reel on an entry side of said work rolls to a coiling reel on an exit side of said rolls, motor means including reel motor tension controllers for driving said coiling and uncoiling reels at speeds maintaining constant tension on said workpiece on the entry and exit sides of said work rolls, a mill module control unit for outputting an instruction signal to said hydraulic roll-gap control system on the basis of any difference between a reference rolling pressure and an actual rolling pressure during rolling detected by a load cell, the improvement comprising a tension controller separate from the tension controllers for said reels and disposed on at least said entry side of said work rolls, said separate tension controller comprising: a tension detector for detecting the tension applied to the workpiece, means for applying a force directly to said workpiece to tension same, and means for adjusting the tension in said workpiece by varying the force exerted by said force applying means on said workpiece in response to a difference between a predetermined reference tension and the tension detected by said tension detector whereby any fluctuation in tension of said workpiece in response to a predetermined change in said roll gap is immediately detected and tension restored by said tension controller independently of operation of said reel drive tension contollers.

2. The system according to claim 1 wherein the tension controller comprises a pressure roll for pressing the workpiece, a hydraulic cylinder for driving said pressure roll toward the workpiece and a servo valve for controlling a flow rate to said hydraulic cylinder on the basis of said difference between a predetermined reference tension and the tension detected by said tension detector, said difference comprising said predetermined condition.

3. The system according claim 1 wherein said tension detector comprises a load detector for detecting reaction force applied to guide means disposed in a path of the workpiece.

4. The system according to claim 1 wherein the force exerted by said tension controller is modified on the basis of a detected radius of coiled workpiece around a reel.

5. The system according to claim 1 wherein the force exerted by said tension controller is modified on the basis of a signal from a speed detector for detecting a feed speed of the workpiece.

6. The system according to claim 1 wherein the tension contorller comprises a fluid support mechanism for forming a fluid film to support the workpiece and a control valve for controlling an output quantity of said fluid support mechanism on the basis of said difference between a predetermined reference tension and the tension detected by said tension detector, said difference comprising said predetermined condition.

7. The system according to claim 6 wherein said tension detector comprises a load detector for detecing reaction force applied to guide means disposed in a path of the workpiece.

8. The system according to claim 1 wherein the tension controller comprises electromagnet for applying attracting force to the workpiece and a regulator for regulating said attracting force of said electromagnet on the basis of any difference between a predetermined reference tension and the tension detected by said tension detector, said difference comprising said predetermined condition.

9. The system according to claim 8 wherein said tension detector comprises a load detector for detecting reaction force applied to guide means disposed in a path of the workpiece.

* * * * *